US007603969B2

(12) United States Patent
Repple et al.

(10) Patent No.: US 7,603,969 B2
(45) Date of Patent: Oct. 20, 2009

(54) AUTOMOTIVE COOLANT PUMP APPARATUS

(75) Inventors: Walter Otto Repple, London (CA); John Robert Lewis Fulton, Royal Oak, MI (US)

(73) Assignee: Flowork Systems II LLC, Royal Oak, MI (US)

( * ) Notice: Subject to any disclaimer, the term of this patent is extended or adjusted under 35 U.S.C. 154(b) by 72 days.

(21) Appl. No.: 12/064,974

(22) PCT Filed: Aug. 30, 2006

(86) PCT No.: PCT/CA2006/001419

§ 371 (c)(1),
(2), (4) Date: Feb. 27, 2008

(87) PCT Pub. No.: WO2007/025375

PCT Pub. Date: Mar. 8, 2007

(65) Prior Publication Data

US 2008/0216775 A1 Sep. 11, 2008

(30) Foreign Application Priority Data

Aug. 30, 2005 (GB) ..... 0517583.1

(51) Int. Cl.
*F01P 7/14* (2006.01)
*F01P 5/10* (2006.01)
*F04D 15/00* (2006.01)

(52) U.S. Cl. ..... 123/41.1; 123/41.44; 415/160

(58) Field of Classification Search ..... 123/41.1–41.08, 123/41.44–41.47; 415/145, 159–165
See application file for complete search history.

(56) References Cited

FOREIGN PATENT DOCUMENTS

JP 54137532 A * 10/1979

* cited by examiner

*Primary Examiner*—Noah Kamen

(57) ABSTRACT

An automotive coolant pump has movable vanes, which are adjustable as to their orientation in accordance with the temperature of the coolant, whereby the rate of coolant flow through the pump impeller accords with coolant temperature. A thermal-actuator is operated by a thermal-sensor, and serves to rotate a vanes-drive-ring to cause the vanes to change orientation in unison. The cooling system includes a bypass-port, which is open during warmup and closed once coolant has acquired working temperatures; the same thermal-actuator serves also to operate the bypass-port-blocker. Additionally, the same thermal-actuator may serve also to operate a radiator-port-blocker, which serves to block flow through the radiator during engine warmup. The vanes may be arranged to close completely together, and to be sealed at closure. Sealing is effected e.g by elastomeric sealing elements arranged on the appropriate surfaces of the vanes. The vanes lie sandwiched between top and bottom plates, which press the vanes with a small resilient force. The plates and vanes, together with a retainer, form a pre-assembly module. The vanes also are profiled to maximize efficiency over the range of orientations and conditions.

20 Claims, 17 Drawing Sheets

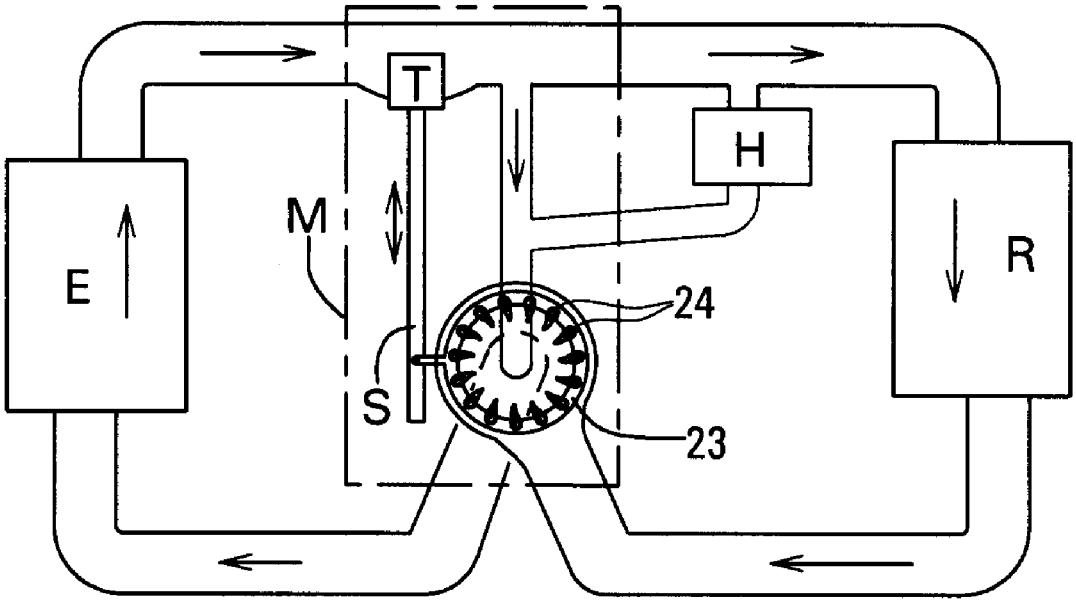
FIG 1
FIG 13
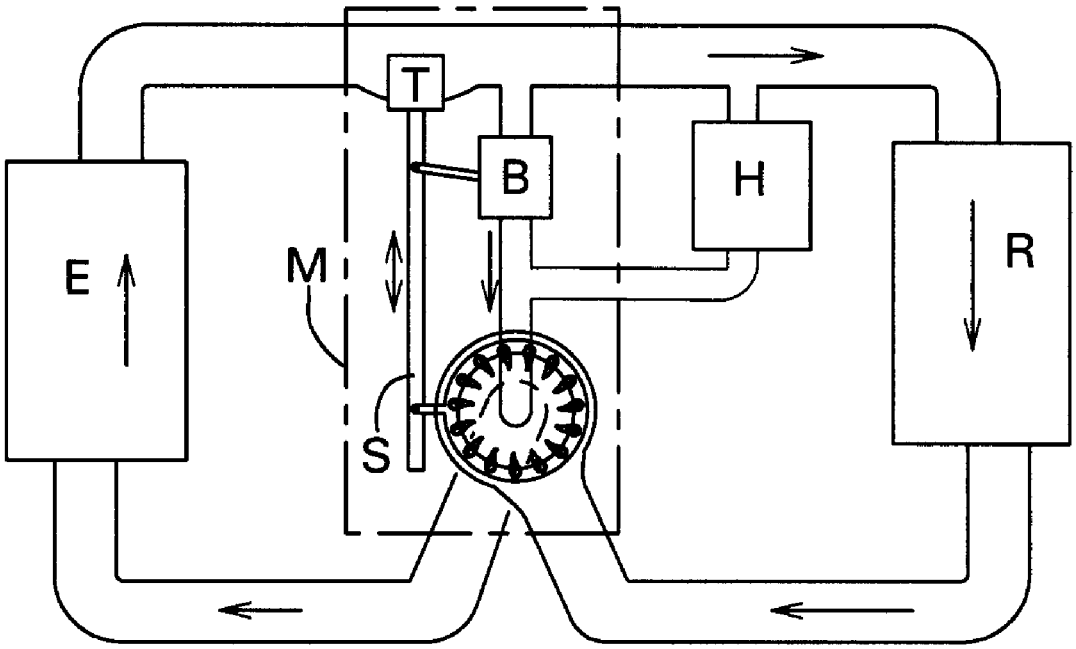

FIG 2
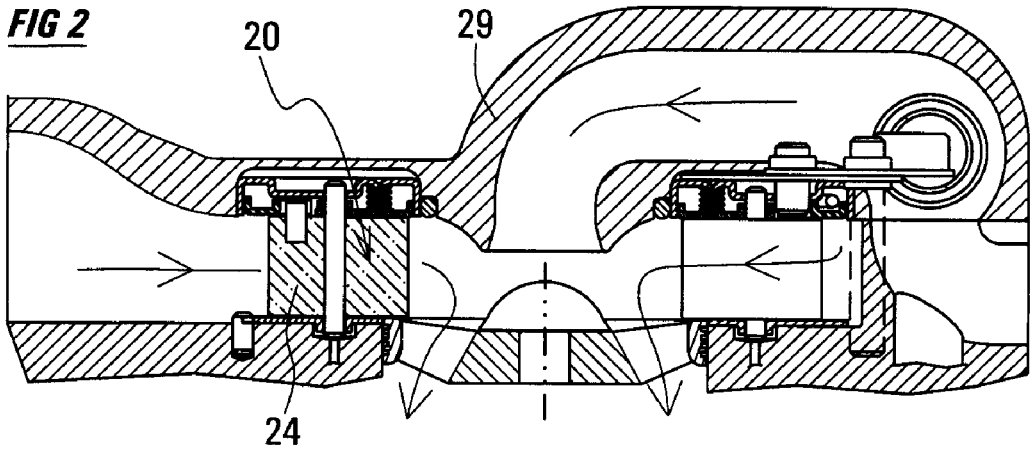
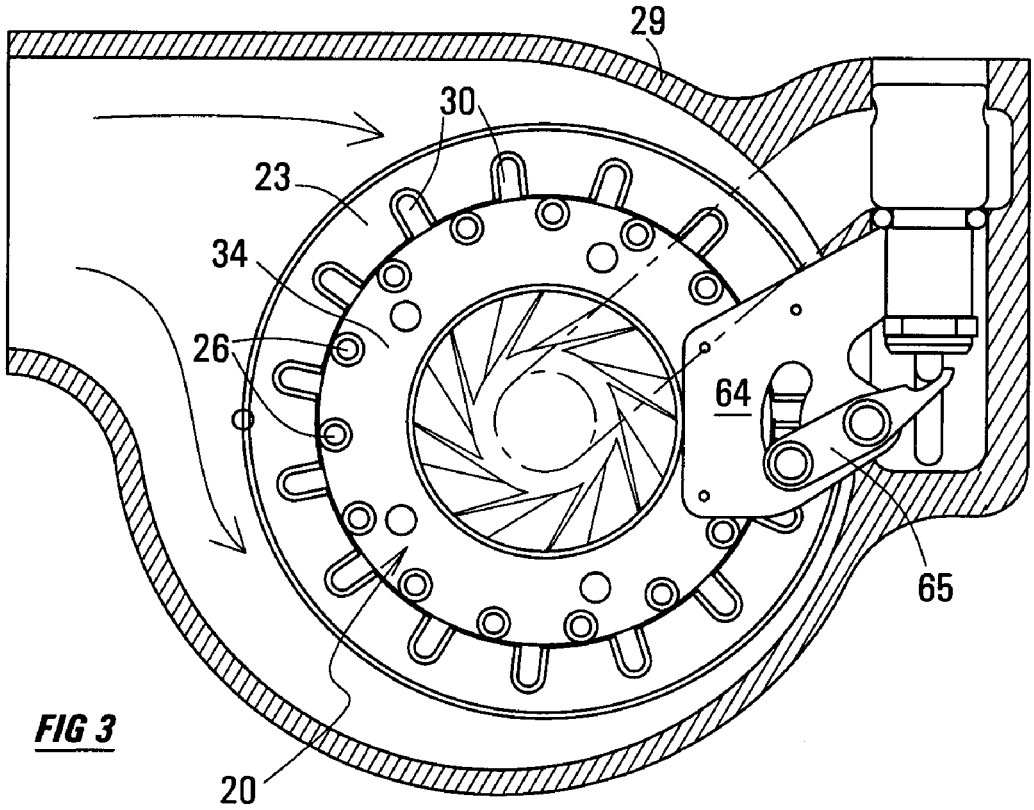
FIG 3

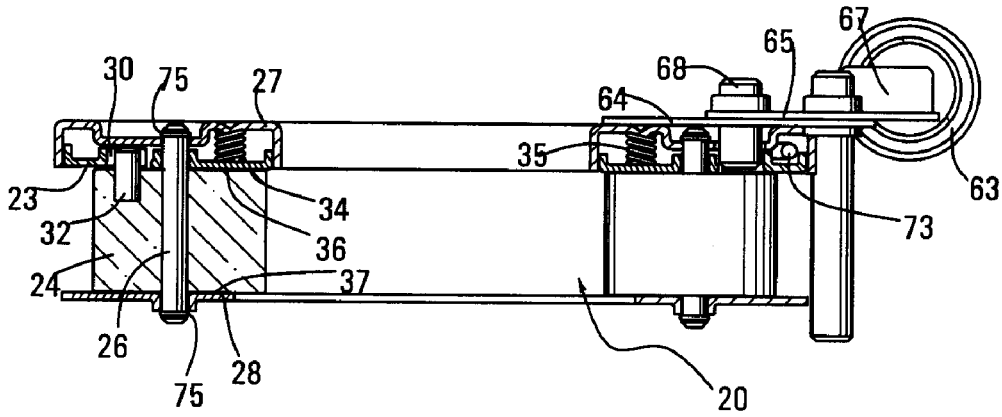
FIG 4
FIG 11
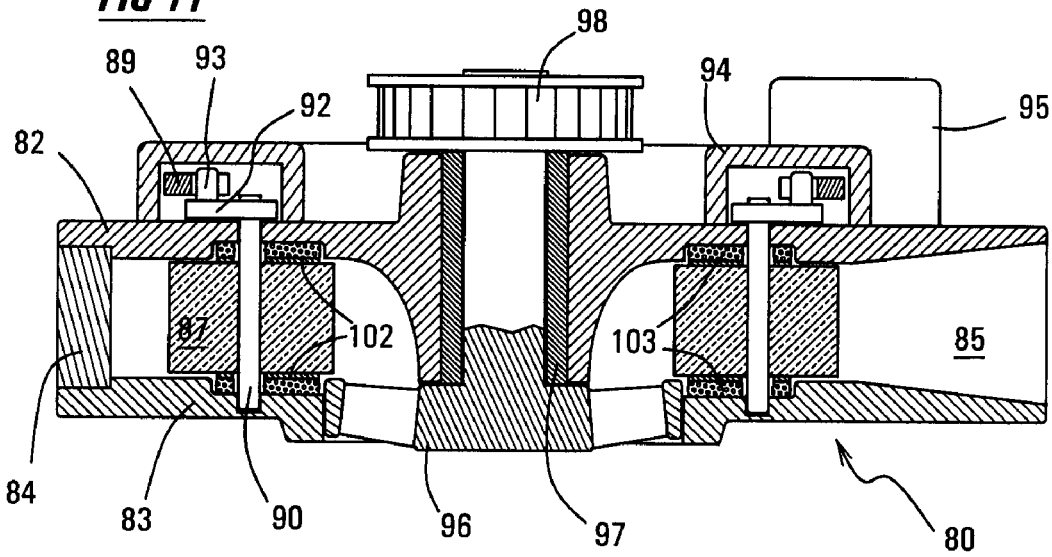

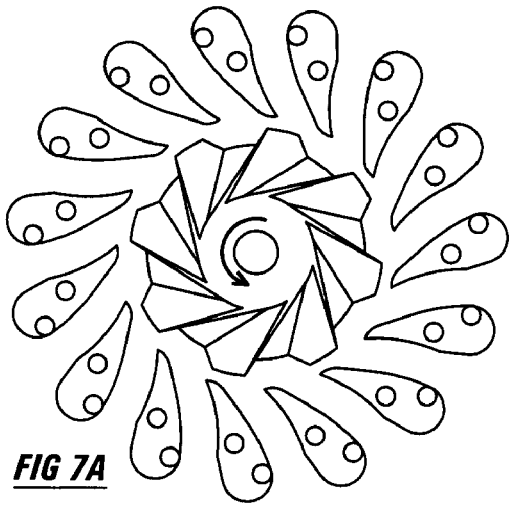
FIG 7A
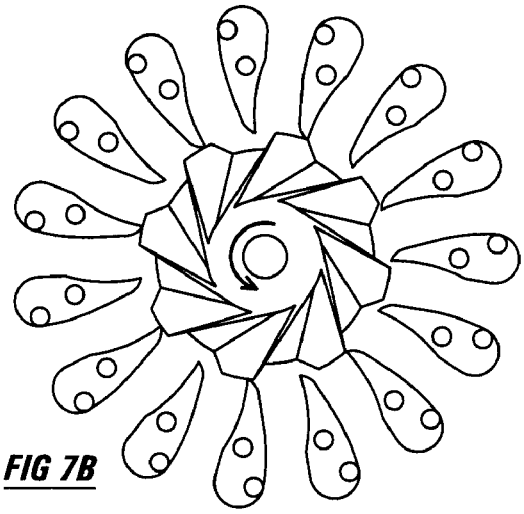
FIG 7B
FIG 7C
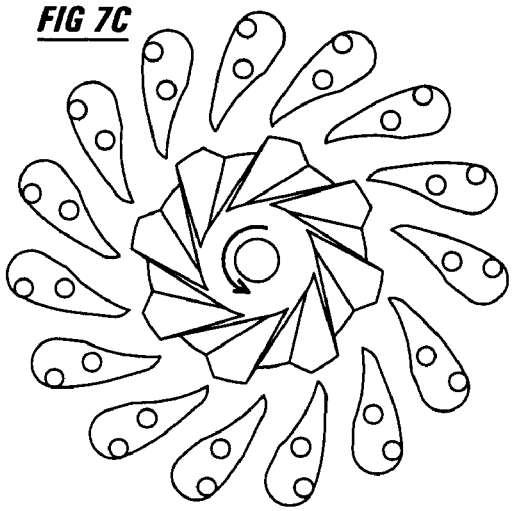
FIG 7D
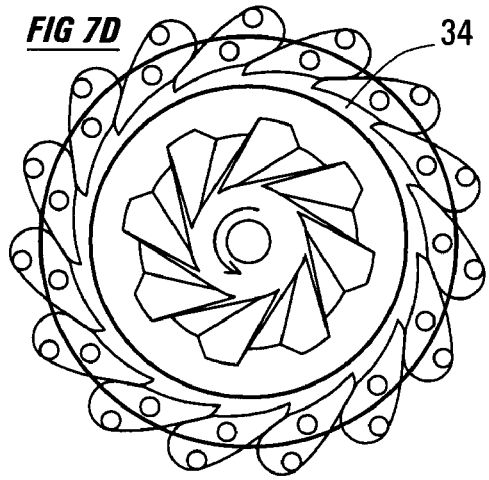
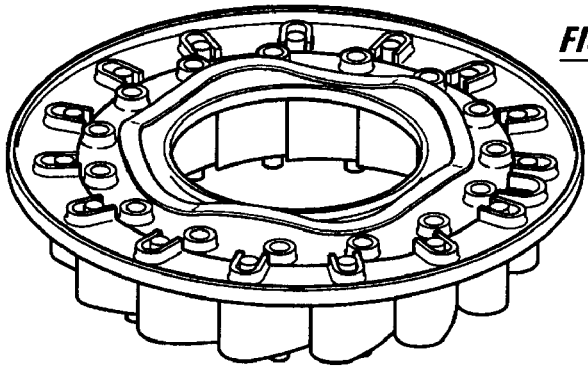
FIG 6

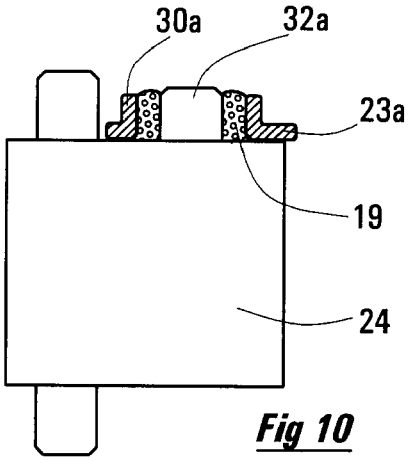
Fig 10
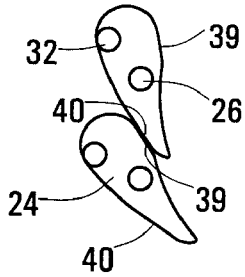
FIG 8
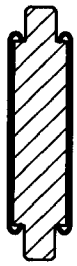
Fig 9b
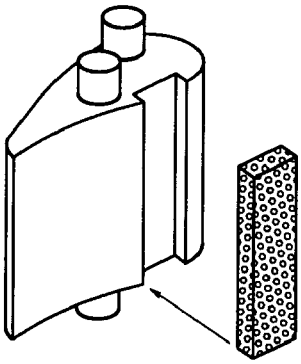
Fig 9a
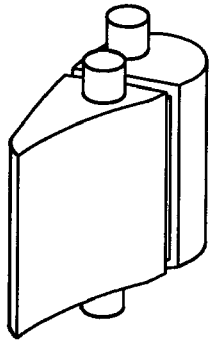
Fig 9c
Fig 16c
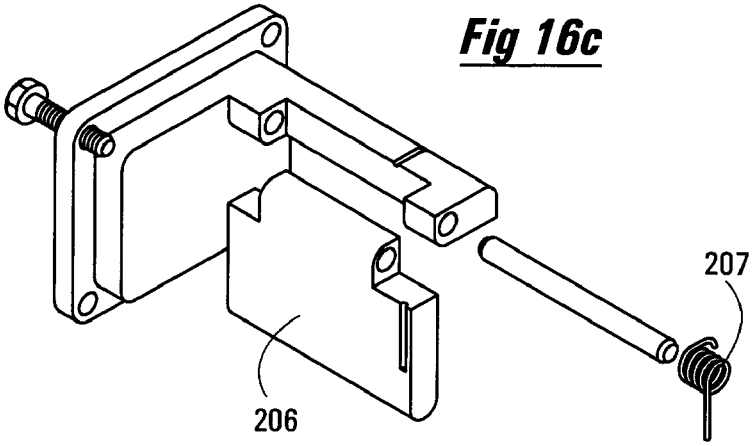

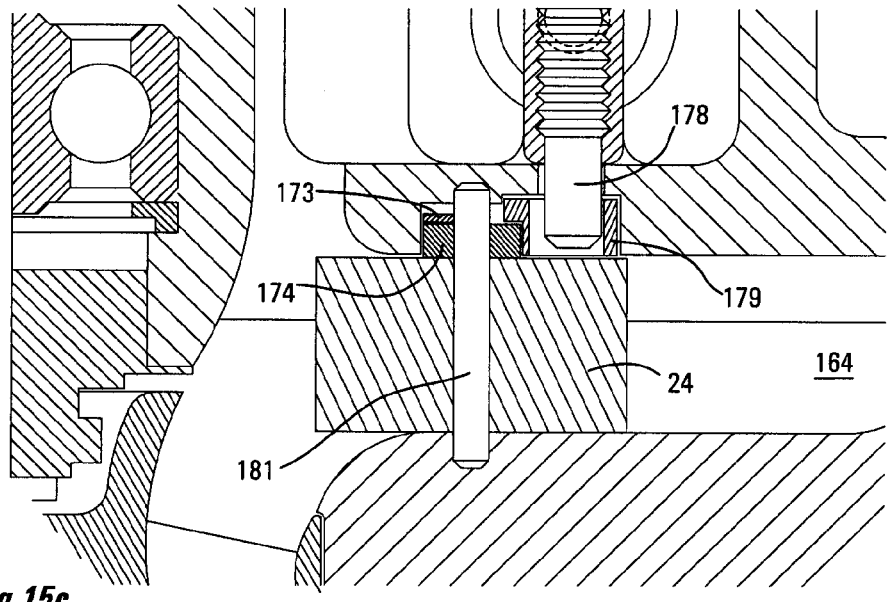
Fig 15c
Fig 17
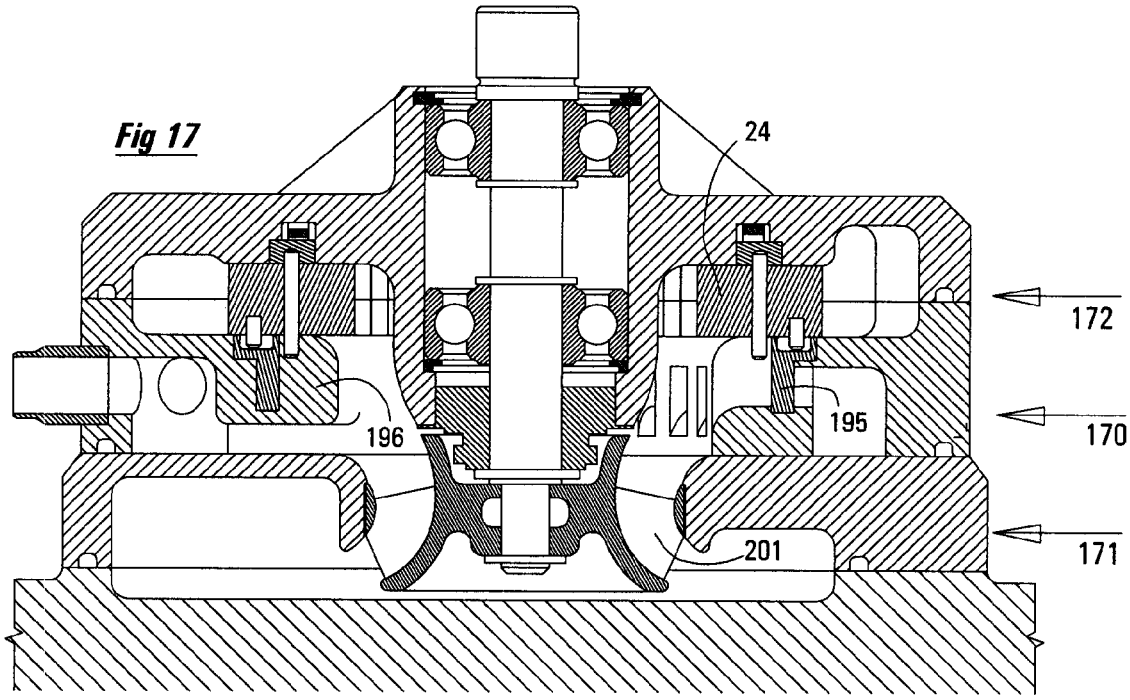

AUTOMOTIVE COOLANT PUMP APPARATUS

SUMMARY OF THE INVENTION

The technology described herein relates to coolant circulation pumps, mainly in an automotive context, and to the type of pump in which movable vanes are used for controlling flow through the pump.

Patent publication WO-04/59142, to which attention is directed, discloses a coolant pump of the above type.

BRIEF DESCRIPTION OF THE DRAWINGS

Exemplary embodiments of the invention will now be described with reference to the accompanying drawings, in which:

FIG. 1 is a diagram of the layout of the circulation system of an automotive engine.

FIG. 2 is a sectioned view of a circulation control module, together with associated components of the engine in which it is installed.

FIG. 3 is a plan view of the module of FIG. 2.

FIG. 4 is a sectioned close-up view of the module, standing alone.

FIG. 6 is a similar view to FIG. 5, showing some of the assembled components, and with a different from of spring.

FIGS. 7*a*-7*d* are diagrams showing the phases of orientation movement of the vanes within the module, from open to closed.

FIG. 8 is a close up of the vanes, showing the manner of sealing together.

FIGS. 9*a*,9*b*,9*c*,9*d* show other ways in which the vanes can be sealed.

FIG. 10 shows a portion of a vanes-drive-ring of the module, showing resilience within the vane-slot thereof.

FIG. 11 is a sectioned view of another circulation control module.

FIG. 13 is a diagram similar to FIG. 1, but includes an addition to the system.

FIG. 15*c* is a close-up of a portion of FIG. 15*b*.

FIG. 16*c* is a close-up of a flap-valve of FIG. 16*a*.

FIG. 17 is a sectioned side view of the module of FIG. 16*a*.

DETAILED DESCRIPTION OF THE DRAWINGS

Figure 5:
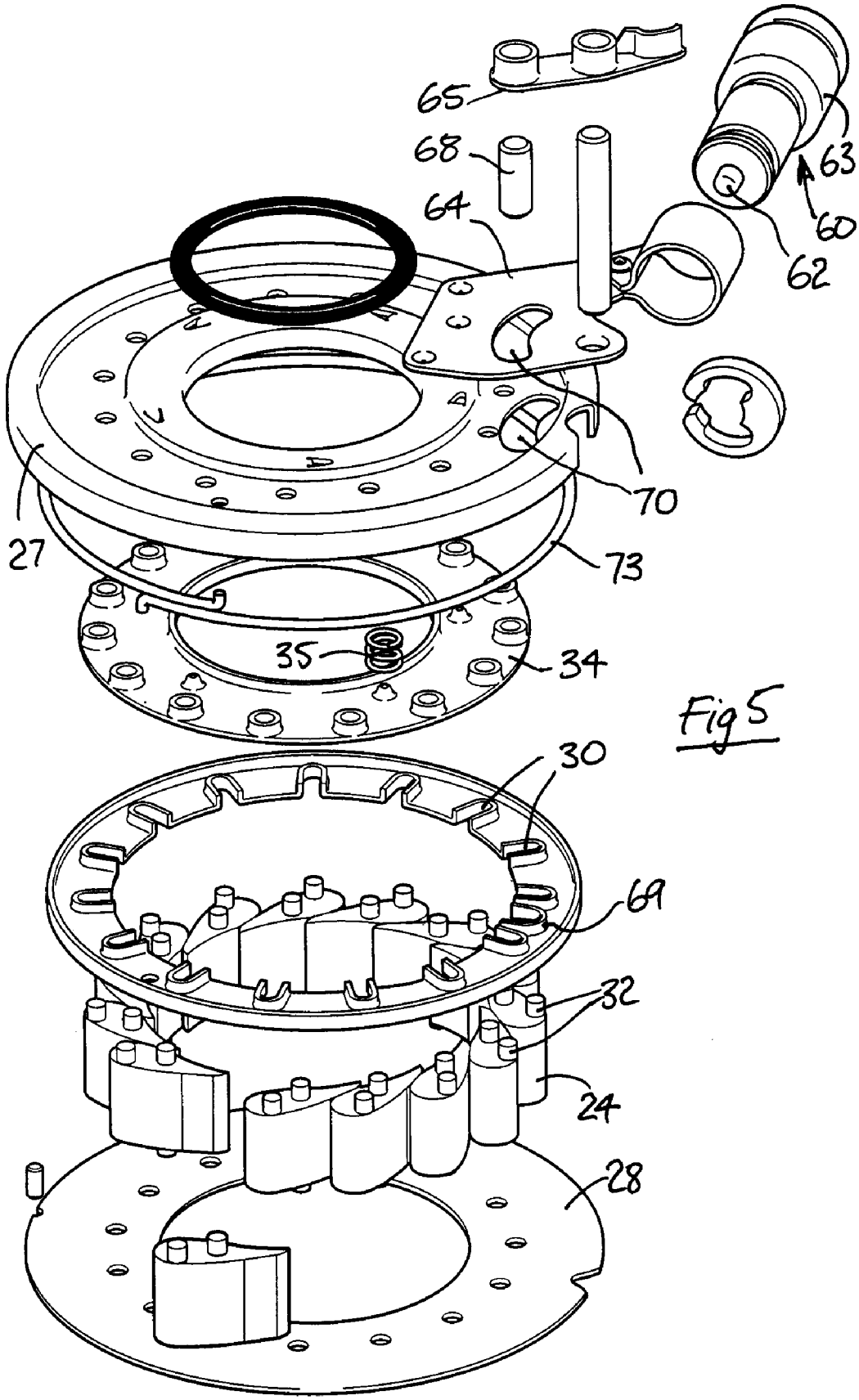
FIG. 5 is a pictorial view of the module, shown in exploded format.

The apparatuses shown in the accompanying drawings and described below are examples. It should be noted that the scope of the patent protection sought is defined by the accompanying claims, and not necessarily by specific features of exemplary embodiments.

FIG. 1 is a diagram showing the general layout of a coolant circulation system for an automotive engine. Coolant is directed around the engine E, radiator R, heater H, and other components not shown, by the circulation control module M. There are, of course, many arrangements, configurations, further components, etc, of circulation systems in use for engine cooling; the one in FIG. 1 is typical. The technology described herein is applicable generally.

Included in the module M is a thermal sensor T. Coolant emerging from the engine E washes over the thermal sensor T. A thermal actuator, being the stem S, is attached to the thermal sensor T, and the stem S moves (in the up/down sense in FIG. 1) in accordance with the temperature as measured by the thermal sensor.

The stem S is configured, when it moves up/down, to cause vanes-drive-ring 23 to rotate. This rotary movement of the vanes-drive-ring in turn moves the several vanes 24, which in turn dictates the angle at which coolant emerging from the radiator R enters the impeller blades on the pump rotor. (The impeller is not shown in FIG. 1, but it is co-axial with the axis of the circle on which the vanes are pitched.) The hotter the coolant, the further down the stem S moves. Thus, the temperature of the coolant dictates the angle at which the coolant enters the impeller blades. The system is designed such that the hotter the liquid, the more the coolant is directed into the blades, whereby, other parameters being constant, coolant flowrate is proportional to coolant temperature.

The module M normally receives coolant from the radiator. When the coolant is cold, the thermal sensor T holds the stem S in the up position, and the system is designed such that, in this position, the vanes close together, and completely block flow from the radiator R. When the coolant is cold, a bypass flow reaches the impeller through the bypass port 22, and thus circulates around the engine. Thus, the module M in FIG. 1 serves, not only to render the flowrate of warmed-up coolant proportional to coolant temperature, but serves also as a conventional engine thermostat, to cut off flow to/from the radiator when the coolant is cold.

Thus far, the system described in FIG. 1 follows generally the technology as disclosed in the said patent publication WO-04/59142.

The structure of the module M (being module 20 in FIG. 2 and following) will now be described in more detail.

The vanes 24 (fifteen of them in this case—see FIGS. 7*a*-7*d*) are carried on respective vane-spindles 26 (see FIG. 4). (The vanes are absent in FIG. 3.) The vane-spindles 26 pass between a top plate 27 and a bottom plate 28. The plates 27,28 are designed to be stationary once assembled in the housing 29 (which may be included in the engine block, cylinder head, pump housing, or other structure, as designed).

The vanes-drive-ring 23 of the module is mounted and guided for pivoting rotation with respect to the top and bottom plates 27,28. Vane-slots 30 in the vanes-drive-ring 23 pick up vane-pegs 32 in the vanes 24, whereby the vanes 24, in unison, undergo pivoting movement, as driven by the rotation of the vanes-drive-ring 23. The rotation of the vanes-drive-ring 23 is controlled by the thermal actuator.

Concentric with the vanes-drive-ring 23 lies a sealing-plate 34. The sealing-plate 34 is located in place by the vane-spindles 26, and thus is constrained against rotational movement in the housing 29. The sealing-plate 34 is, however, free to float vertically. Springs 35 urge the sealing-plate 34 down into touching contact with the top faces 36 of the several vanes 24. The bottom faces 37 of the vanes are urged down, in reaction to the springs 35, into contact with the bottom plate 28.

The springs 35 provide a force constantly urging touching contact between the sealing-plate 34 and the top faces 36 of the vanes 24, and between the bottom faces 37 of the vanes and the bottom plate 28. The sealing plate 34 is flat, and smooth, as is the bottom plate 28, and as are the top and bottom surfaces 36,37 of the vanes—so much so, that coolant liquid is prevented from passing over or under the vanes. Thus, the designer can now expect to realise, or almost realise, the ideal that, when the vanes are oriented to the closed position (which happens when the coolant is cold), substantially no liquid can pass through or by the vanes.

FIG. 5 shows the components of the module in an exploded mode. FIG. 6 shows the assembled unit, except with the top plate and bottom plate removed. In FIG. 6, also, the coil springs of FIG. 5 have been replaced by a wave-spring.

When the vanes 24 are closed, i.e when the coolant is cold, the vanes have to seal against each other. FIGS. 7*b*,7*c* show the vanes in different partly-open conditions, in plan view. FIG. 7*a* shows the vanes in the full-open condition. FIG. 7*d* shows the vanes 24 in the fully-closed position. Also, in FIG. 7*d*, the sealing-plate 34—or rather, the position occupied by the sealing-plate—has been indicated.

These figures also show a particularly-preferred profile of the vanes. The port through which coolant entering the vanes from the radiator may be characterised as heart-shaped in at least some of the apparatuses depicted herein. Thus, the coolant entering through the vanes on the left side tend to have a more direct path through the vanes than coolant entering from the right side, which has to undergo more of a change of direction. To minimise the effects of this difference, the vanes should be profiled as shown, with a substantially semi-circular entry profile, which serves to receive the coolant almost uniformly from all angles of approach. Also, the vanes should be pitched such that, at least approximately, the spaces between the vanes are equal to the thicknesses of the vanes, when measured on the circle that includes the thickest part of the vanes. The vanes should also be profiled such that, at the FIG. 7*a* orientation, when the flowrate is a maximum, the spaces between the vanes progressively and gradually narrows as the radius becomes smaller (and hence the velocity of the coolant progressively and gradually increases as it approaches and enters the impeller.

The vanes 24 do have to be carefully engineered such that, when they are closed, they seal together to a more-or-less watertight extent. This is accomplished, in the illustrated structure, by precision manufacture. It has been found that the components can indeed be manufactured so exactly that there is (virtually) no leakage between, nor over and under, the closed vanes.

FIG. 8 shows the detail of the form of the vanes 24, at closure. Each vane has an inner-sealing-facet 39 and an outer-sealing-facet 40. These facets are designed such that, when together, there is face-to-face contact of the facets, over a relatively large area. When two surfaces need to be leakproof when touching, designers often engineer line-contact between the surfaces. However, when the closure does not have to be absolutely leakproof, a large-area face-to-face contact can be the more effective, in that a large area face-to-face contact is much more accommodating of slight mismatches and misalignments—within limits, of course. It has been found that the kinds of mismatch errors that do creep in, even with precision manufacture, can be readily accommodated if the sealing surfaces are large-area face-to-face. Thus, the facets 39,40 are so designed, when they touch together, as to do so over a large area.

However, it is also the case, with a large-area face-to-face contact, that dirt particles might become trapped between the two (large) facets. It will be understood that the vanes close together as the coolant cools down, after the engine has been switched off (perhaps an hour after, in some cases), and when the coolant liquid is perfectly still. Thus, if there are any particles of dirt in the coolant, they will not tend to be flushed out from between the facets, as they might if the coolant were flowing, i.e moving, at the time of closure.

Accordingly, some designers may prefer to provide line-contact between the vanes 24, at closure, rather than the face-to-face contact between large facets. Vanes in line-contact are less likely to be held slightly apart by dirt than are face-to-face contact facets.

FIGS. 9*a*,9*b*,9*c* show other ways in which the vanes can be engineered to ensure more or less completely sealed closure. In FIG. 9*a*, elastomeric strips are carried in suitable slots formed in the surfaces of the vanes onto which sealing contact is desired. Preferably, however, each vane should be sealed, at closure, all around its whole circumference. FIG. 9*b* is a section through the pivot pin of the vane, and shows a layer or coating of sealing material enveloping all but the protruding ends of the pin.

In FIG. 9*c*, a groove has been formed around the whole circumference of the vane, and a suitably shaped elastomeric sealing ring is placed in the groove.

Figure 9D:
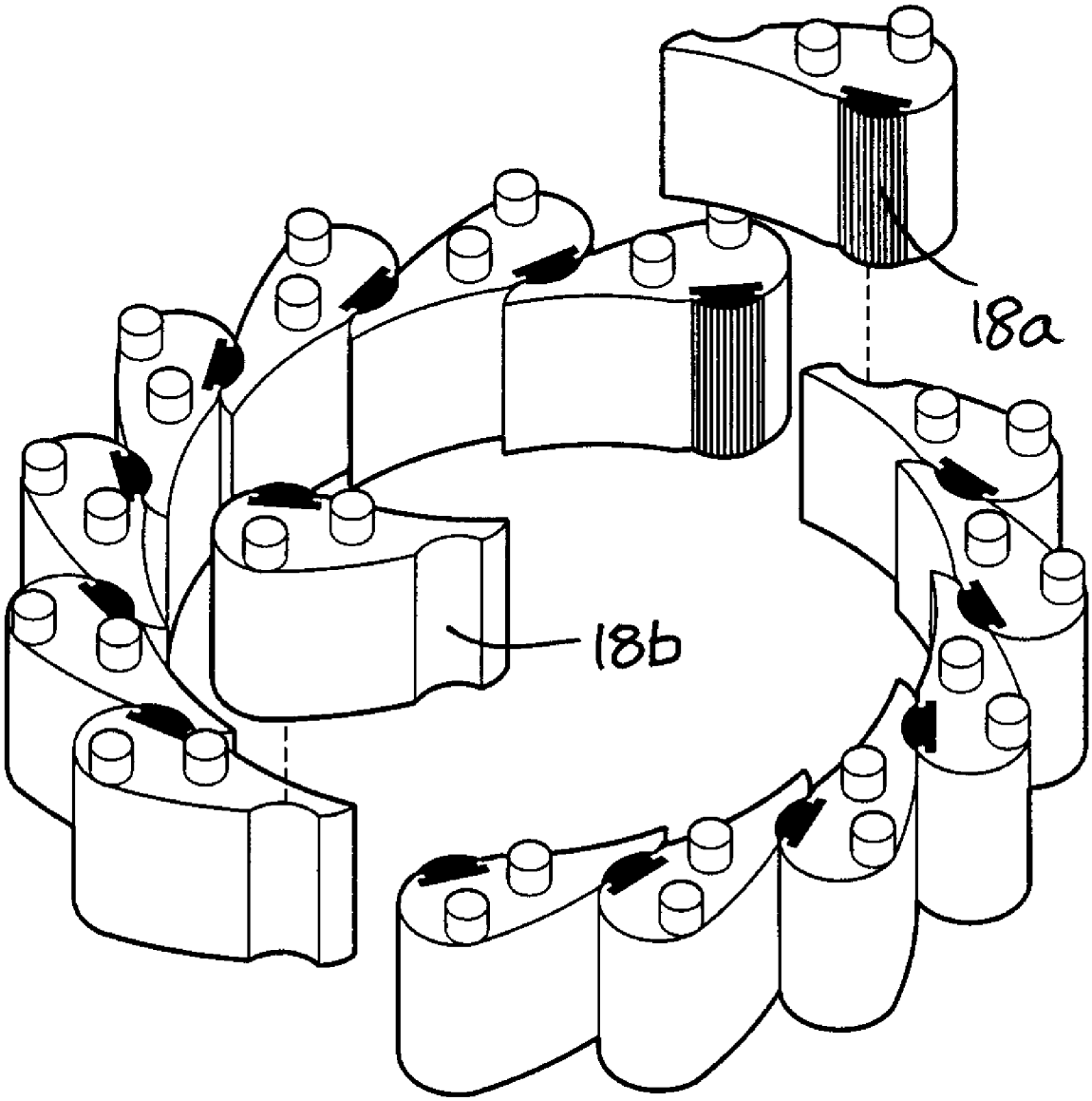

FIG. 9*d* shows a complete set of vanes, in which profiled strips of sealing material are dovetailed into the vanes, the convex faces 18*a* of the strips engaging corresponding concave surfaces 18*b* in the sides of the vanes. In this version, the seals only cater for the sides of the vanes, of course; the tops and bottoms of the vanes are sealed between the flat surfaces of the sealing-plate 34 and the bottom-plate 28.

It should be noted that the elastomeric seals are not subjected to highly demanding pressures or severe rubbing and abrasion. Thus, the seal material does not especially need to be hard-wearing, although it should be resistant to the kinds of chemicals likely to be encountered in automotive coolant. The seals can be made of soft, easily-conformable material; even a resilient cellular elastomeric material.

Another approach to the design task of ensuring that all the vanes lie fully closed together, when the coolant is cold, is shown in FIG. 10. Here, the vanes-drive-ring 23*a* has been provided with a resilience or compliance 19 at the point where the vane-slots 30*a* in the ring engage with the drive pegs 32*a* of the vanes 24*a*. The compliance accommodates the fact that, inevitably, as the respective vanes close up, they will close one after the other, i.e not simultaneously. The compliance is in the form of a soft elastomeric valve-plate around the peg, which will "give" slightly, with respect to the vane-slot in the vanes-drive-ring. The compliance will allow the corresponding compliances of the other vane-slots still to continue to push their respective vanes each into their respective full-closed positions.

There are numerous other ways in which compliance can be built into the vane-drive-ring, whereby the designer can provide for the forces that drive the respective vanes each into full closure to be at least semi-independent of the forces driving the rest of the vanes into full closure.

Details of the thermal actuator of the module 20 will now be described. The task of the thermal actuator is to cause the vanes-drive-ring 23 to rotate in response to a change in temperature as sensed by the thermal sensor. The thermal sensor in this case comprises basically the same basic unit as is found in a traditional wax-type automotive thermostat 60 (FIG. 5). A stem 62 moves in/out with respect to a bulb 63, when the temperature of the bulb 63 changes.

The nature of the mechanical drive between the thermal unit and the vanes-drive-ring 23 is shown in FIGS. 4,5. A mounting plate 64 is fastened to the top-plate 27, and the wax thermostat unit 60 is clamped into the mounting plate 64. A lever 65 is pivoted in the mounting-plate, and the lever receives the movements of the stem 62 of the thermostat unit on a face 67 of the lever.

The other end of the lever 65 carries a drive-peg 68. The drive-peg 68 engages in a slot 69 in the vanes-drive-ring 23. (In fact, the slot 69 lies between two of the drive-slots 30 which engage the vane-pegs 32 of the vanes.) The lever 65 lies above the top-plate 27, but an aperture 70 in the mounting-plate 64 (and in the top-plate 27) enables the movement of the drive-peg 68 to be transmitted through to the vanes-drive-ring 23 underneath the top-plate 27.

As mentioned, incoming coolant from the engine/heater sets the temperature of the bulb 63, whereby the angle of the vanes (and hence the flowrate produced by the pump) is proportional to the coolant temperature.

The stem 62 pushes the vanes-drive-ring 23 to rotate, against the action of a torsion spring 73. The torsion spring 73 returns the components to their cold position as the coolant cools down.

The structure of the module 20 described above is modular, in the sense that the components thereof are manufactured and assembled as a separate unit, i.e separate from the rest of the coolant pump or engine. The module is designed so that the module can be finish-assembled to a sufficient degree that the module can be finished, as a functional unit, and can be fully tested, and can then be shipped, as a unit, to the engine assembly line, where it can be installed (manually or automatically) into a suitable receptacle that has been machined in the coolant pump housing, engine block, cylinder head, etc, without having to be re-tested, and without requiring skilled assembly or adjustment.

In order to form a complete module that can be tested, transported, and handled, as a single integrated unitary structure, the components of the module 20 as shown in FIG. 4 are held together by means of suitable ring-clips 75 on the vane-spindles 26. The ring-clips 75 prevent the top plate 27 and bottom plate 28 from separating from the vane-spindles. The designer may specify other means, i.e other than the ring-clips on the vane-spindles, for holding the plates from separating, and for reacting the force of the springs 35, to retain the module as a unitary whole structure prior to its being assembled into its housing.

The (large) components of the FIGS. 4,5 module 20 are formed mainly as sheet metal stampings. Designers might alternatively prefer to form the components of the module mainly as plastic mouldings. FIG. 11 shows a module 80 that is done mainly in plastic.

Apart from the general materials difference, another difference between the module 80 of FIG. 11 and the module 20 of FIGS. 4,5 is that in the module 80 the coolant from the engine/heater is fed in radially, i.e from the side, whereas in the module 20 the coolant is fed in axially, i.e in line with the axis of the pump impeller. This difference is dictated by the layout of the engine and of the cooling system.

In the module 80, again the components include a top plate 82 and a bottom plate 83, now done as plastic mouldings. The module also includes a moulded spacer 84. The spacer 84 is solid with the top and bottom plates upon assembly of the module. Snap clips are used to snap the plates 82,83 to the spacer 84, whereby the components, once assembled, cannot be separated. (If separation is desired, the clips could be made accessible.)

Figure 12A:
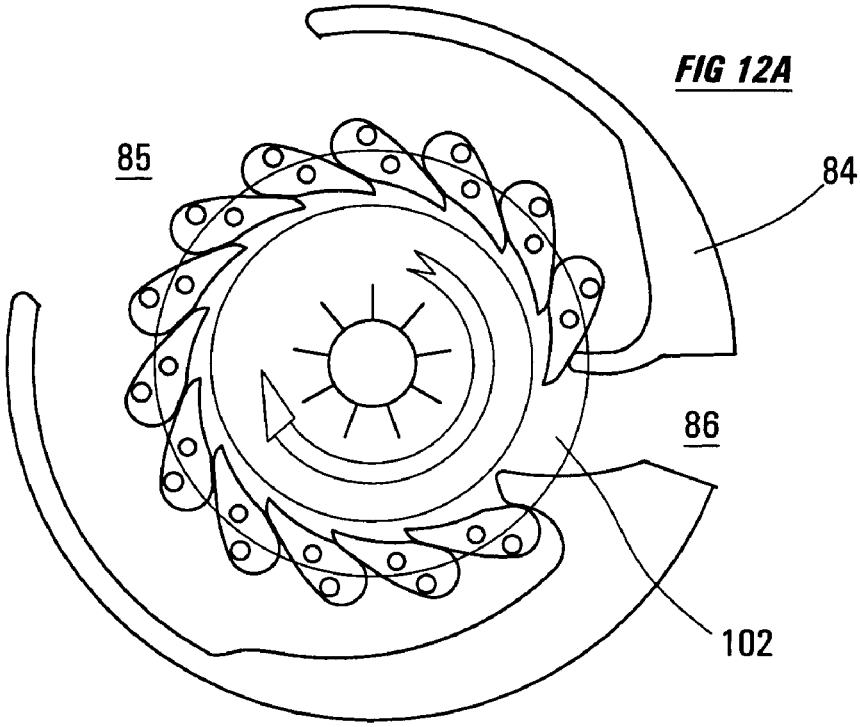
FIGS. 12*a*,12*b* are plan views of some of the components of the module of FIG. 11.
Figure 12B:
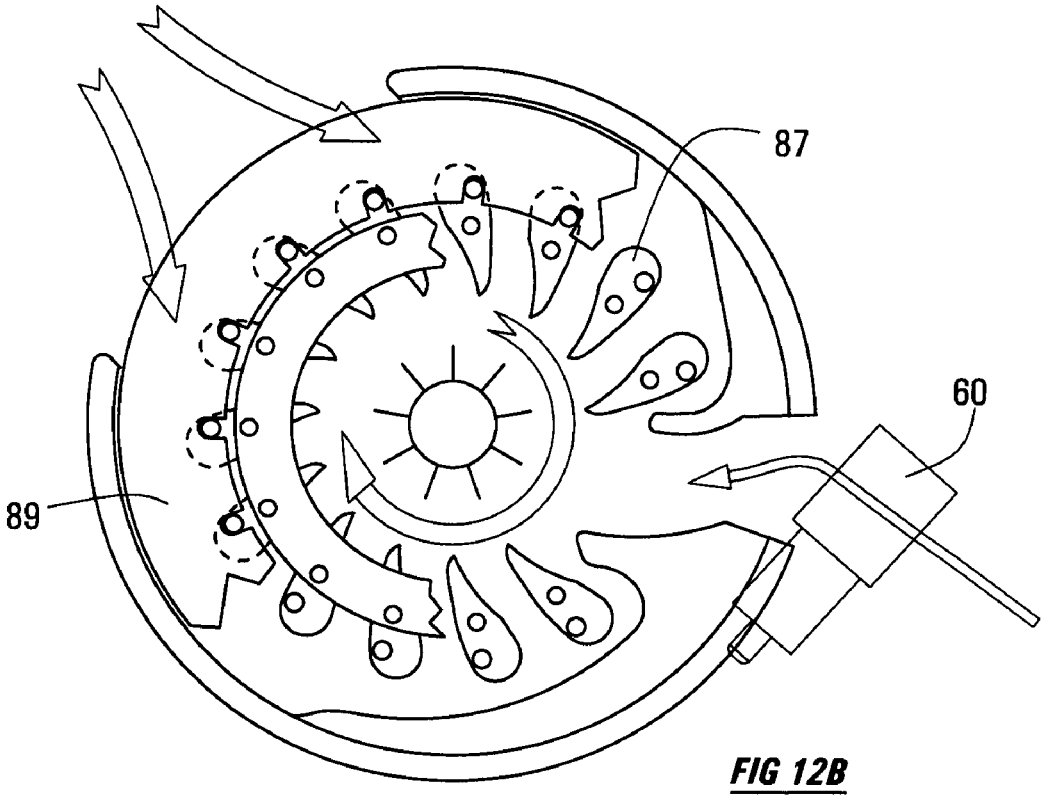

The spacer 84 is shaped (FIG. 12*a*) to provide a radiator-port 85 for the incoming coolant from the radiator, and an engine/heater-port 86 for the incoming coolant from the engine and/or heater. The bulb of the thermal-sensor 60 is located in the engine/heater-port 86 (FIG. 12*b*), where it is bathed in a mixture of water coming directly from the engine and water that has passed through the heater. As mentioned, since the engine/heater flow comes in from the side, a space is left between the (thirteen) vanes 87, to enable coolant entering through the engine/heater-port 86 to pass through to the impeller, whereby the engine/heater-port 86 remains open to the impeller, even when the vanes 87—and consequently the radiator port 85—are closed. The closed condition is illustrated in FIG. 12*a*, and the open, warmed-up, condition is shown in FIG. 12*b*.

Of course, the designer might find that some of the components are better done in metal, and some are better done in plastic. The point here is that the modularity aspect can be engineered with components in both materials.

The module 80 differs from the module 20 also as to the manner in which the rotary motion of the vanes-drive-ring 89 is transmitted to the vanes 87. Referring to FIG. 11, the vane-spindle 90 of the vanes 87 carry respective arms 92; the vane-spindle (and therefore the vane) turn when the arm 92 is operated. The arms 92 carry respective drive-pegs 93, and it is the drive-pegs 93 that are pushed when the vanes-drive-ring 89 rotates. Thus, the operating mechanism for the vanes is now outside the ports and conduits that are wetted by the coolant. The mechanism is housed inside a cover 94, the thermal sensor/actuator components being housed inside a cover-extension 95 to the cover 94.

In the module 80, the pump rotor, including the pump impeller 96, is shown as being an integrated component of the module. The rotor runs in a bearing/seal shown diagrammatically at 97. A drive pulley 98 receives power via a suitable belt drive. The module 20, by contrast, did not include the rotor, although it could alternatively have done so, in an equivalent manner to that shown in FIG. 11. (Of course, if the rotor is driven by a belt-drive, the designer must account for the side-loads on the housing due to belt tension.)

The module 80 differs from the module 20 also in another respect. In FIG. 11, there are floating seal-plates 102 both above and below the vanes 87. The two floating seal-plates float on respective mats 103 of resilient elastomeric material, for example a synthetic cellular material. The material of the mat 103 not only should have a low coefficient of friction and be soft, but should also be resilient. The resilient material of the mat 103 abuts against surfaces in the top and bottom plates 82,84. Thus, the vanes 87 themselves are also able to float vertically, thereby enabling the equalisation (and thereby the minimisation) of the forces acting on the vanes, which minimises the frictional resistances to motion of the vanes.

Thus, module 20 differs from module 80 in that module 80 uses resilient elastomeric material 103 where module 20 uses coil springs 35. Another difference is that in module 20 the vanes are resiliently loaded against the solid bottom-plate 28, whereas in module 80 the vanes float between two opposed resiliences. Again, these differences can be interchanged.

The resilient cellular material 103 functions not only to provide a resilience, but functions also to provide a seal, in itself. Consequently, the cellular material should be of the non-interconnected-cell, or closed-cell, type.

It might be considered, in relation to FIG. 11, that the vanes could be sealed if the vanes were to be in contact directly by the resilient cellular elastomeric material, i.e without a seal-plate being interposed therebetween. The seal-plate preferably should be a continuous complete ring. Preferably, it is made of smooth low-friction material, even when the other components are of plastic.

However, although the seal-plate must have an adequate service life, the seal-plate is not called upon to support heavy forces or abrasion, and the seal-plate could alternatively be made of a (rigid) plastic material. In fact, a plastic seal-plate can be formed as an engineered hard skin on elastomeric cellular material, and that can reduce manufacturing costs.

The seal-plate should be flat and smooth and hard, and relatively rigid (compared with the resilience supplied by the springs or elastomeric material), and thus be able to guide the vanes to reside all at the same level, and all in the same plane, i.e with none of the vanes protruding above or below the others by any more than its (tiny) manufacturing differences. The seal-plate should not be so thin and flimsy as would affect that capability. Thus, the function of the resilience is to enable the vanes to float; the function of the seal-plate is to urge all the vanes to remain in one single plane, while floating.

The resilience (springs, elastomeric cellular material, etc) should be arranged to press against the seal-plate evenly, around its circumference. If pressing at isolated points, these should be at least four in number, and preferably more. One preferred manner in which the required resilience can be provided is in the form of a wave-spring. Here, a continuous ring of thin sheet metal is stamped and formed into an undulating multi-waved configuration. Again, preferably there should be at least four points of contact between the wave-spring and the seal-plate. Use of a wave-spring is shown in FIG. 6*a*.

The pump rotor 96 is driven to revolve by a suitable driver, which in the examples is a drivebelt from the crankshaft or camshaft. Alternatively the rotor can be gear-driven from the engine, or it can be driven by an electric motor. (The impeller typically is driven at a faster speed than the engine crankshaft.)

As was disclosed in the said WO/-04/59142, by the use of the thermally-controlled vanes, the thermostat typically found in automotive engines can be eliminated. The thermostat function is simply added to the motion of the single thermal actuator, which is provided in any event to operate the vanes. In the present case, the single thermal actuator has been harnessed to perform yet another task, as will now be described.

In FIG. 13, as compared with FIG. 1, a valve or flow inhibitor 109 is provided in the bypass B. The valve 109 is operated by the stem S, as are the vanes 24, except that the valve 109 is arranged to pass the bypass flow when the coolant is cold, and to block the bypass flow when the coolant is fully warmed up.

The movement of the stem S can be used to control yet other functions. Alternatively, or additionally, for example, the movement of the stem can be arranged to block the heater flow right off at very cold temperatures, in which case the thermal-sensor then senses only the temperature of the bypass flow; once the bypass flow is warm, now the heater flow can commence. Alternatively again, when the cooling circuit includes a heater-bypass, the designer can arrange for the thermal-sensor and thermal-actuator to open/close the heater-bypass at an appropriate temperature. It will be understood that it becomes possible to provide these sophisticated functions at more or less zero cost, because the mechanism is already provided, to control the movement of the vanes.

The thermal sensor and thermal actuator have been combined, in the above examples, in wax-type conventional automotive thermostat element, as described. Other types of thermostat element are conventional, for example the bi-metal type, which can be utilised also. Alternatively, the thermal sensor and thermal actuator functions can be provided in other ways, for example the sensor function can be derived from information available on the data bus of the engine/vehicle, and the thermal actuator can be provided in the form of a suitable servo mechanism.

In the modules as described, the vanes as shown have spindles that lie parallel to the rotor axis, and parallel to each other. It is possible for the designer to arrange that the vanes spindles be oriented differently—that the spindles lie aligned radially with respect to the rotor axis, for example.

As shown in FIG. 13, coolant may enter the pump impeller as a radiator-flow from the radiator R, through the ring of vanes 24, or may enter as a bypass-flow via a blocker unit B. The radiator-flow is blocked at lower temperatures, when the circle of vanes 24 is closed, and is open at higher temperatures. The bypass-flow is blocked when the blocker B is closed, at higher temperatures. The blocker B is open at lower temperatures. FIG. 1 also shows a heater-flow of coolant passing through the heater H. The heater-flow can be subject also to temperature control, or can be arranged simply to remain open at all temperatures.

As shown diagrammatically in FIG. 1, a thermal actuator in the form of a stem S modulates the orientation of the vanes in response to temperature as measured by a thermal sensor T. Also, the thermal actuator, being the stem S, operates the blocker B. (In an alternative apparatus that functions correspondingly to the exemplary apparatuses described herein, the term "stem" might be inappropriate to describe the component of the apparatus that transmits the thermally-actuated motion from the thermal-actuator. The component might in such a case be better described as a shaft, rod, lever, etc. The term "arm" is generic to all such components.)

Figure 13A:
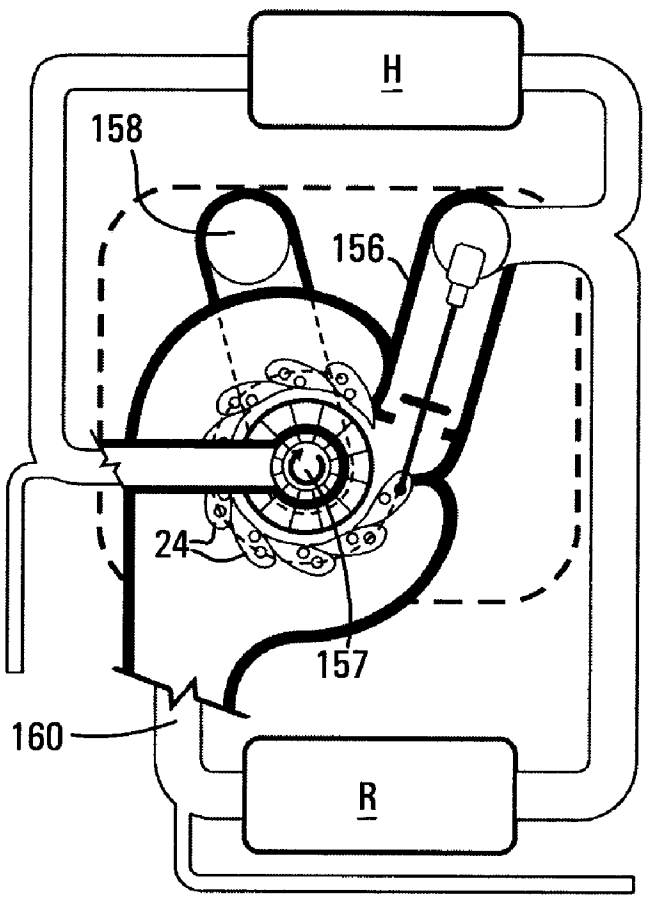
FIGS. 13*a*,13*b* are diagrams showing the system of FIG. 13 in more detail.
Figure 13B:
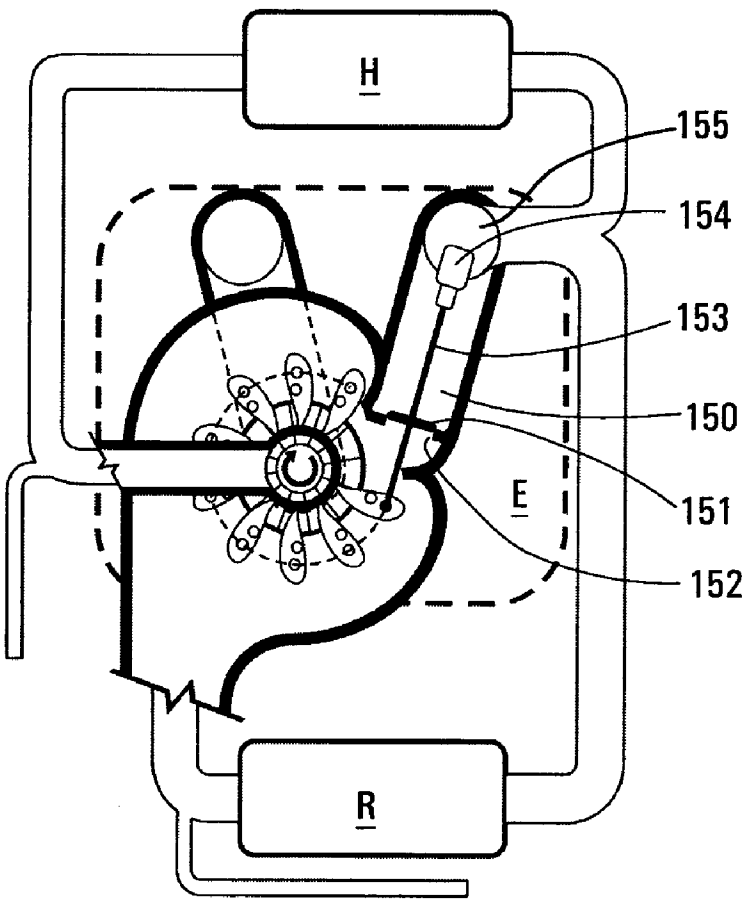

As shown in more mechanical detail in FIGS. 13A,13B, the blocker unit B includes a bypass-port 150, and a bypass-port-blocker. The bypass-port includes an aperture 152 and the bypass-port-blocker takes the form of a valve-plate 151 which is engageable with the aperture 152. The valve-plate 151 is carried on stem 153. At the upper end of the stem 153 is a wax-bulb thermal unit 154, which is bathed by the coolant emerging from the engine E, in the conduit 155. The thermal sensor/activator unit 154 is fixed into the housing 156 of the blocker unit, and the stem 153 protrudes from the thermal unit 154 by a distance that changes in accordance with the temperature of the engine coolant. In FIG. 13A, the coolant is cold, and the valve-plate 151 is separated from the seating of the aperture 152, whereby coolant emerging from the engine can pass through the bypass-150, straight into the pump impeller 157, and straight back into the engine, via the out-to-engine conduit 158. (In FIG. 13A, the rotary axis of the impeller of course is perpendicular to the plane of the drawing, and the coolant flows axially (i.e down into the paper) through the impeller, and then into the conduit 158.)

The designer's intent, at these cold temperatures, is that the coolant should warm up as rapidly as possible.

As shown in FIG. 13B, once the coolant becomes warm, and then hot, now the vanes 24 open, and coolant entering from the in-from-radiator port 160 can enter the impeller and pass through the engine. Now that the coolant is warmed up, the temperature of the coolant is controlled by modulating flow through the radiator, by controlling the orientation of the vanes 24. The coolant being warm/hot, the bypass-port is blocked, and can no-longer bypass the radiator. (Not all the coolant necessarily goes through the radiator R—some of the coolant goes through the heater H, and some through the other auxiliary circuits.) In the apparatus of FIGS. 13A,13B, the closing of the blocker unit B is performed by the stem 153, i.e by the same stem that was operational in operating and modulating the orientation of the set 23 of vanes 24. Thus, the operation and control of the blocker unit B is accomplished virtually without additional cost.

In an alternative cooling circuit, the flow through the heater H also is blocked at cold-start temperatures. In that case, flow through the heater is only enabled after the coolant is (somewhat) warmed up. Again, the heater-blocker is activated from the same stem that modulates the vanes, and again, control of the heater blocker is accomplished virtually for nothing.

FIG. 13B shows the components in the warmed-up condition. The vanes are open, allowing flow through the radiator. The flow is thermally-modulated by the vanes, as explained in WO-04/59142. When the coolant is warm/hot, the valve-plate 151 is engaged into the seating of the aperture 152, blocking the bypass flow.

As shown in FIGS. 13A,13B, the vanes 24 do not completely encircle the impeller 157. Rather, flow through the bypass-port 150 enters the impeller 157 through a circumferential gap in the vanes, as will be understood from the drawings. In FIG. 13, by contrast, for comparison with FIG. 1, the vanes in that case do completely encircle the circumference of the impeller, whereby (as in FIG. 1) the bypass flow is arranged to enter the impeller from the axial direction. The FIG. 13 arrangement may be termed the axial-entry arrangement, and the FIG. 13A arrangement may be termed the side-entry arrangement.

Figure 14A:
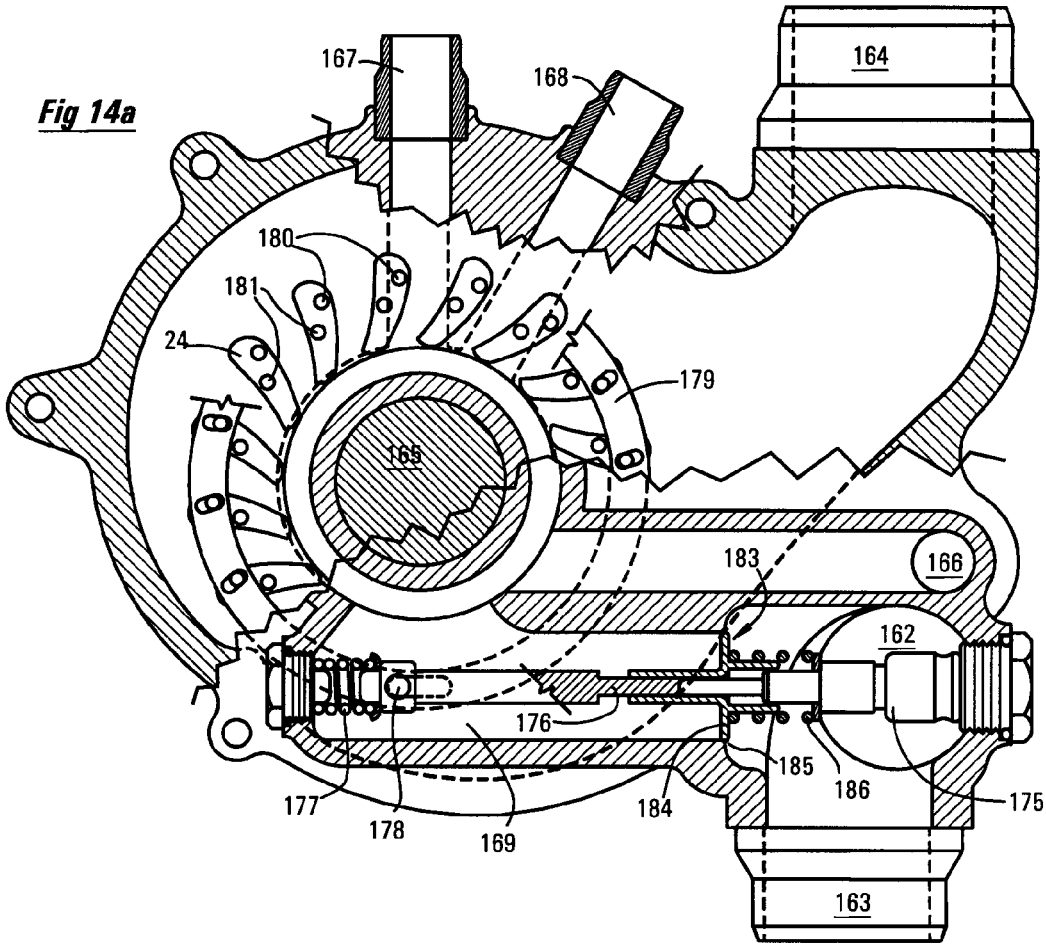
FIG. 14*a* is a sectioned plan of another pump module.
Figure 14B:
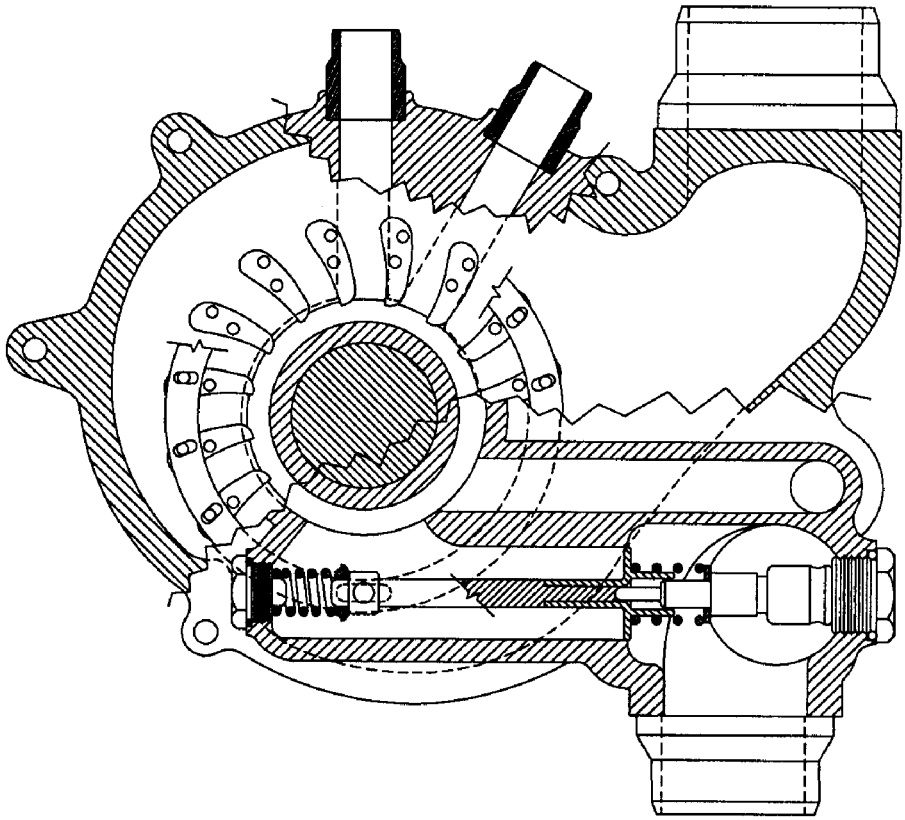
FIGS. 14*b*,14*c* are the same view as FIG. 14*a*, with some of the components in different positions.
Figure 14C:
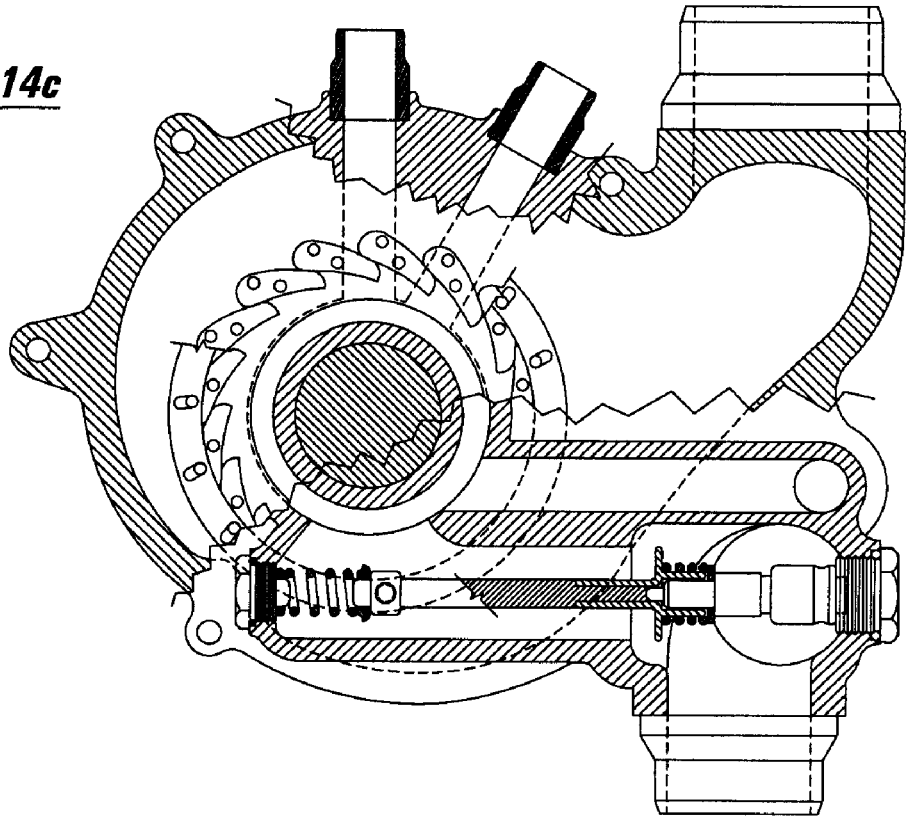

Another arrangement may be termed the split-level arrangement, an example of which is shown in FIGS. 14A, 14B,14C. Here, coolant from the engine enters through the in-from-engine port 162, and passes to the radiator through the out-to-radiator port 163. The cooled return from the radiator enters through the in-from-radiator port 164. This radiator-cooled flow is modulated by passing through the set 23 of vanes 24, and enters the rotary impeller 165. Then, the impelled coolant emerges underneath the impeller (i.e underneath the plane of the drawing) and is thence transferred back into the engine.

The in-from-heater port 166 receives incoming coolant from the heater. The auxiliary ports 167,168 receive incoming coolant from auxiliary circuits. (Such auxiliary circuits might include de-gas, transmission oil cooler, engine oil cooler, exhaust gas recirculation, etc, circuits.)

Figure 15A:
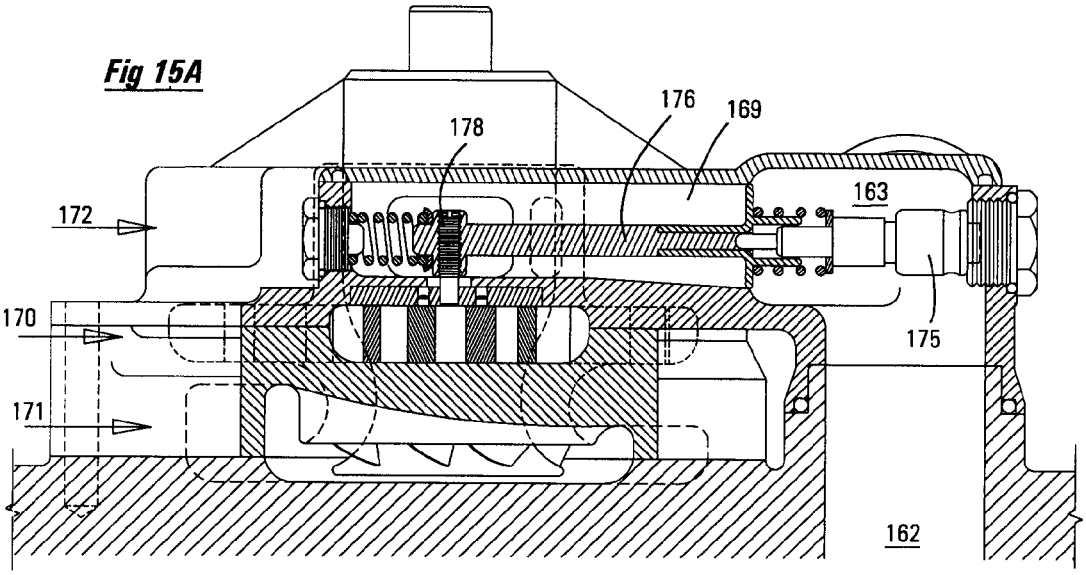
FIG. 15*a* is a sectioned side view of the module of FIG. 14*a*.
Figure 15B:
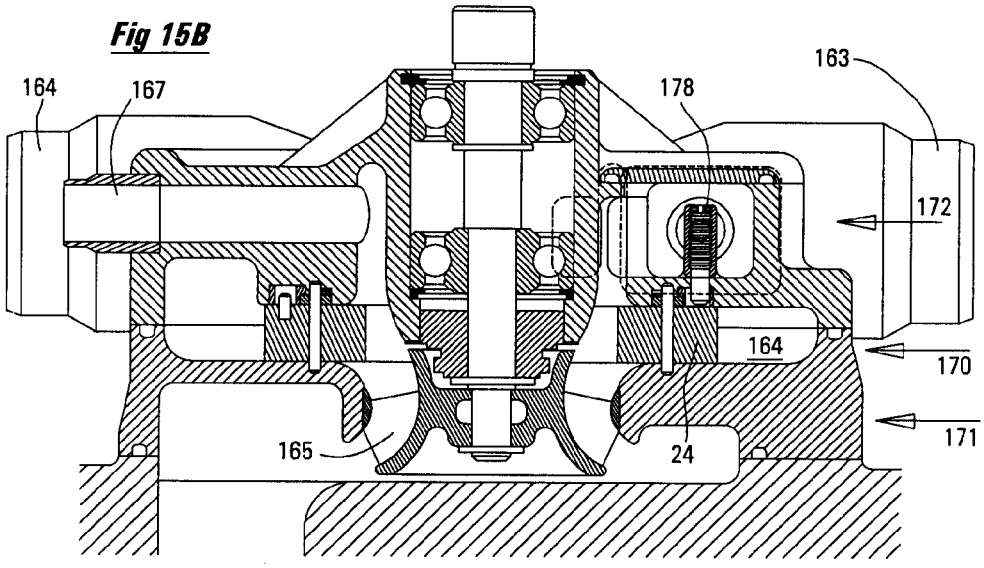
FIG. 15*b* is a different sectioned side view of the module of FIG. 14*a*.

In the FIGS. 14A,14B,14C apparatus, the vanes 24 completely encircle the impeller 165. The bypass port 169, the in-from-heater port 166, and the auxiliary ports 167,168, are all located at a level that is raised above the plane of the vanes, as shown by the cutaway portions of FIGS. 14A,14B,14C, and in the two sectioned views of the same apparatus, in FIGS. 15A,15B. These latter drawings show that the in-from-radiator port 164, and the vanes, are at what may be termed the vanes-level 170, just above the impeller-level 171. The other incoming ports 166,167,168 are located at what may be termed the bypass-level 172, which is stacked above the vanes-level 170 and the impeller-level 171. FIG. 15C shows a sealing-ring 174, which is being pressed down into face-to-face contact with the top surface of the vane 24 by the wave-spring 173. The vane itself is free to float—vertically in FIG. 15*c*—and thus the wave-spring 173 also loads the bottom surface of the vane into face-to-face contact with the surface of the fixed housing underneath the vane. With careful engineering and manufacture, the vanes can be made to seal to the housing more or less 100% in this way.

FIG. 14A shows the apparatus in the hot condition. The vanes 23 are oriented in the full-boost position, having been actuated to that position by the full (leftward) travel of the output rod of the thermal sensor/actuator unit 175. The metal of the stem 176 is in contact with the output rod, and it may be regarded that the rod is a component of the stem 176. A stem-spring 177 keeps the right end of the metal of the stem in firm contact with the left end of the rod.

A post 178 carried by the stem 176 is in engagement with the vanes-drive-ring 179, such that, as the stem 176 moves to the left (which it does when the thermal sensor/actuator 175 gets hotter), the vanes-drive-ring 179 rotates clockwise. Pegs 180 on the vanes engage with the ring 179, whereby when the ring 179 rotates clockwise the vanes 24 pivot clockwise about their respective pivots 181.

In the hot condition shown in FIG. 14A, also the bypass-port 169 is closed. Thus, flow from the engine does not pass straight through the impeller and back into the engine. The bypass-port-blocker 183 closes when the valve-plate 184 of the bypass-port-blocker closes into the aperture 185, which it does at a particular thermally-determined extension position of the stem 176.

It will be understood that it is a simple matter to engineer the correct interaction between the two movements that are produced by the extension of the stem 176, i.e both the rotation of the vanes-drive-ring 179 and the closing of the bypass-port-blocker 183. FIG. 14C shows the situation when the coolant is cold. Now, the stem 176 lies to the right. The bypass-port-blocker 183 is now open, in that the valve-plate 184 is clear of the aperture 185. FIG. 14B shows the situation when the coolant is warm. Now, the thermal sensor/actuator 175 has moved the stem 176 partway leftwards (against the resilience of the stem-return-spring 177). From the warm condition of FIG. 14B to the hot position of FIG. 14A, the stem 176 moves leftwards, while the valve-plate 184 of the bypass-port-blocker 183 remains stationary. The stem 176 slides axially through the valve-plate 184 to permit this, the valve-plate being urged leftwards by the valve-spring 186.

Figure 16A:
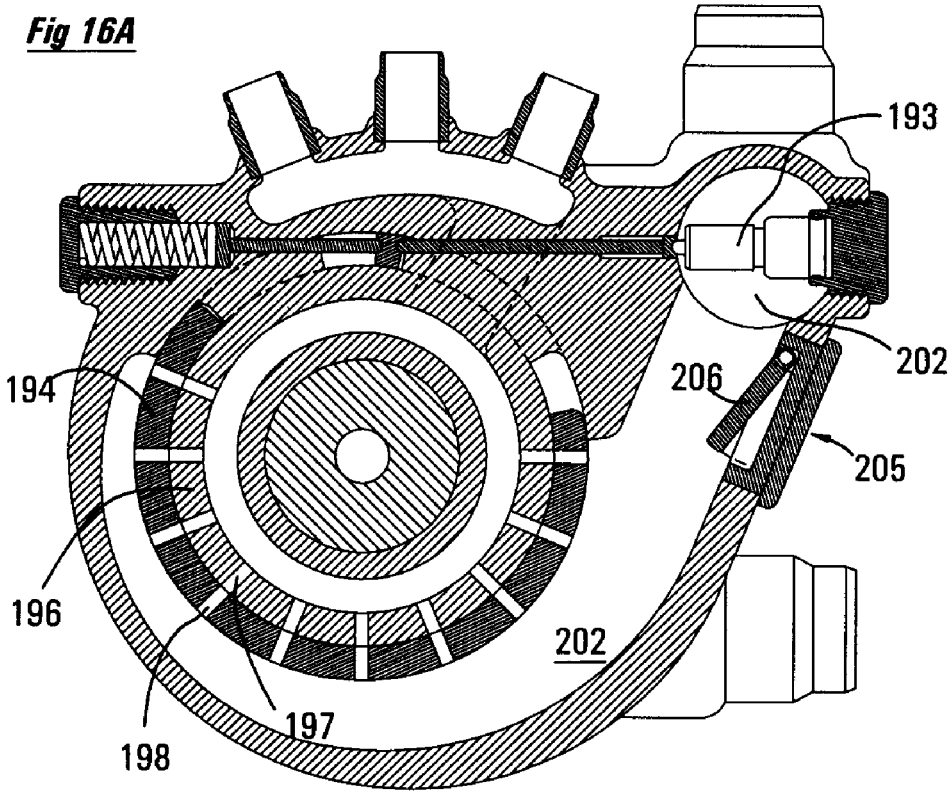
FIG. 16*a* is a sectioned plan of another pump module.
Figure 16B:
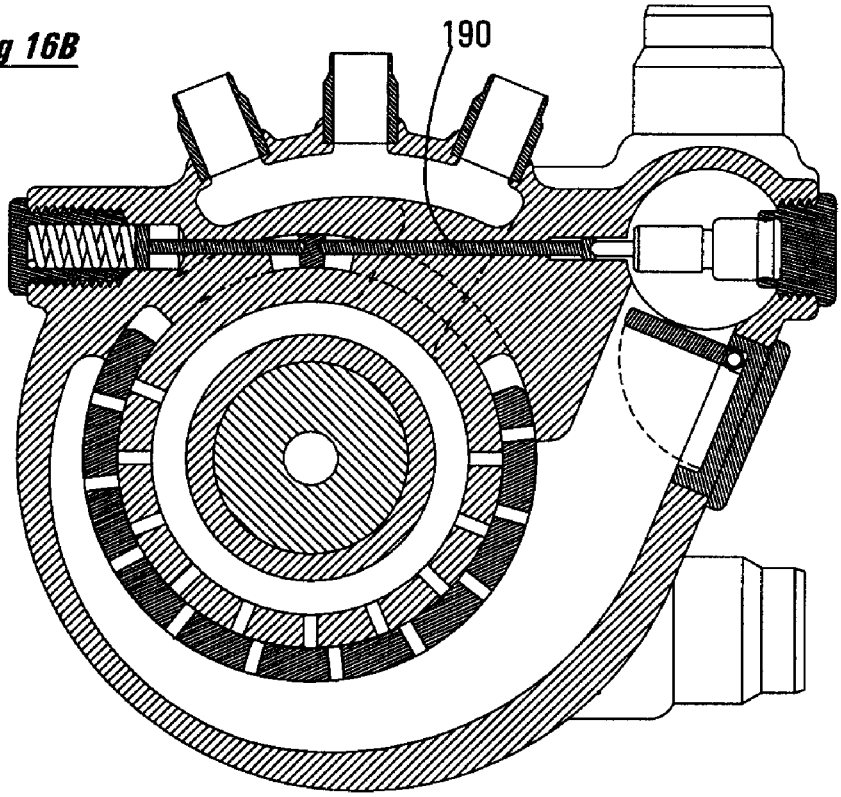
FIG. 16*b* is the same view as FIG. 16*a*, with some of the components in different positions.

Another split-level design is shown in axial section in FIGS. 16A,16B, and in side section in FIG. 17. Here, the stem 190 serves to transmit the motion of the thermal sensor/actuator 193 to the vanes-drive-ring 194, which orients the vanes in accordance with the sensed temperature of the coolant. The vanes-drive-ring 194 also has a skirt 195, which protrudes (downwards in FIG. 17) into engagement with a stator-ring 196. The skirt 195 of the vanes-drive-ring 194 includes a set of ring-ports 197 and the stator-ring 196 includes a set of stator-ports 197,198. When the vanes-drive-ring 194 rotates, the ring-ports 197 move into and out of alignment with the stator-ports 198. FIG. 16A shows the ports in alignment (bypass open), and FIG. 16B shows the ports out of alignment (bypass closed), in accordance with the temperature of the coolant as sensed by the thermal sensor/actuator 193. The design arrangement is that the ports are aligned when the coolant is cold (FIG. 16A). (Note that FIG. 16A does not show it, but in the cold condition the vanes 24 are closed, and therefore flow from the radiator is blocked, in the same manner as in the other designs.) Now, flow from the engine Enters via the in-from-engine port 200, bathes the sensor at 193, and passes through the aligned ports 197,198 between the stator-ring 196 and the skirt 195 of the vane-actuation-ring 196, and thence through the impeller 201, and straight back into the engine.

Once the coolant has been warmed (FIG. 16B), the stem 193 moves to the left, causing the vanes-drive-ring 194 to rotate so that the ring-ports 197 now no longer line up with the stator-ports 198. Thus, now, the bypass-port 202 is blocked, and coolant can no longer pass straight back into the engine. At the same time, i.e as the coolant warms, the vanes 24 open, allowing flow from the engine to circulate now through the radiator. (As mentioned, the vanes are on a different level from the plane of FIGS. 16A,16B as shown in FIG. 17, and are not visible in FIGS. 16A,16B.) As the coolant goes from warm to hot, so the vanes-drive-ring 194 rotates (anticlockwise in this view) further still, moving the vanes towards their full-boost orientation—but still the ports 197,198 remain out of alignment, blocking the bypass port 202.

A variant to the design that was shown in FIGS. 16A,16B, 17 will now be described. It will be understood that the designer can arrange for the vanes-drive-ring 194 to lie a little further clockwise, when the coolant is extremely cold. Thus, when the coolant is merely cold, the ports 197,198 are aligned, as shown in FIG. 16A. And when the coolant is warmer, the ports 197,198 go out of alignment because the ring 194 rotates anticlockwise. But, in the variant, the ports 197,198 also go out of alignment when the coolant is extremely cold, due to the further clockwise rotation of the ring 194, thereby blocking the bypass flow.

When the coolant is extremely cold, it can be advantageous for the designer to arrange to block the coolant from circulating around the engine. Engine designers are aware that an efficient way to reduce engine emissions is to bring engine metal temperatures up as rapidly as possible. Therefore, the designer aims to have the engine warm up as rapidly as possible from a cold start. By halting the circulation flow of coolant when the engine is extremely cold, a reduction in warm-up time can be achieved. The variant as just described is aimed at providing this extra function.

Of course, blocking the circulation of coolant through the engine can be dangerous, in that hotspots might develop and might damage the engine. The designer should take precautions: for example, the designer might arrange that the blocking of the bypass circulation only lasts while the coolant is extremely cold—the designer should see to it that, if the coolant is merely cold, the bypass port is unblocked, allowing bypass-flow to take place. If the designer arranges for the change from bypass-blocked to bypass-unblocked to depend on a temperature measurement, the temperature measurement had better be taken from a location in the engine where hotspots would be likely to occur—for example in or near the valve bridge area.

Figure 18:
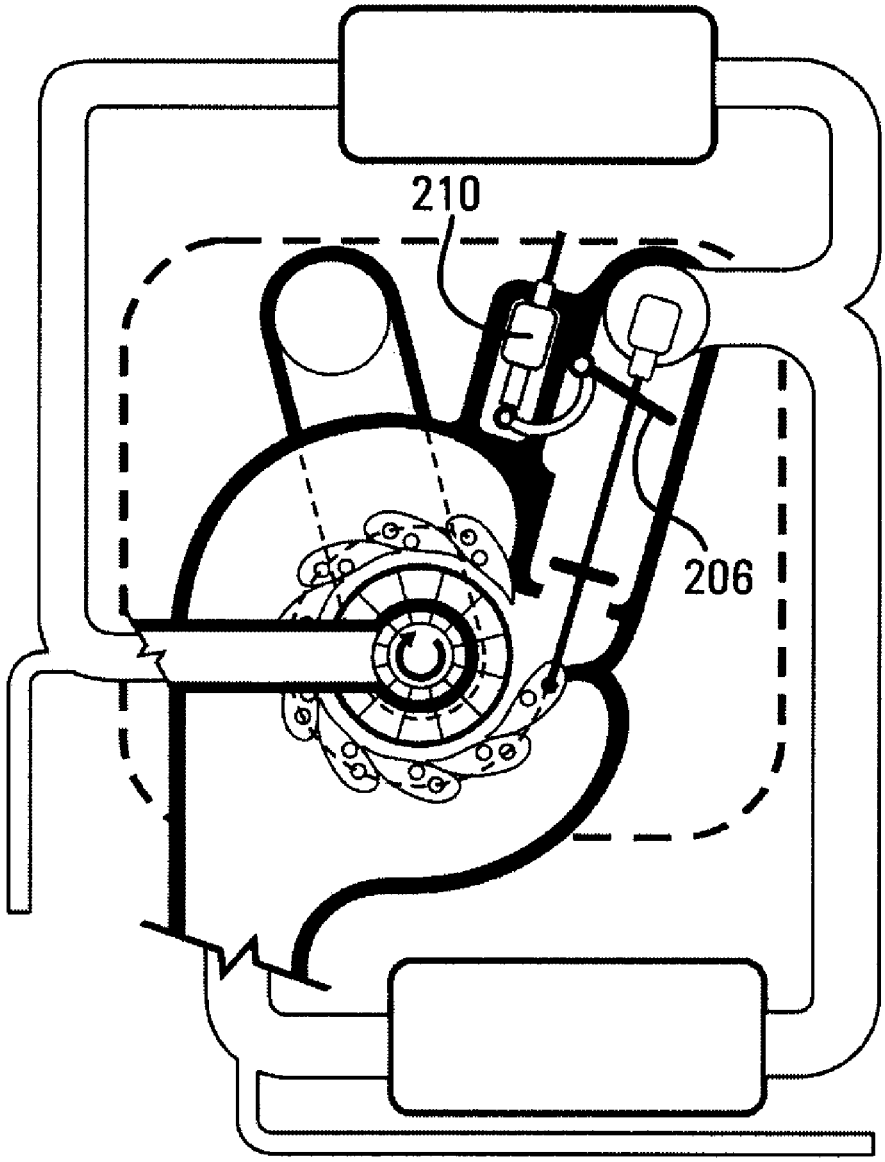
FIG. 18 is a diagram showing an electrically operated flap valve system.

The function of blocking the bypass flow when the coolant is very cold can also be accomplished by means of the flap-valve 205 which is shown in FIGS. 16A,16B, and in detail in FIG. 18. Now, the function of blocking the bypass port 202 is performed by the flap 206, and therefore the vanes-drive-ring 194 does not need to move more clockwise than the position that was indicated in FIG. 16A. The flap-valve 205 is actuated by a light flap-spring 207. The flap-spring 207 urges the flap 206 towards the blocking position as shown in FIG. 16A.

When the engine is idling, the pump impeller 201 being driven from the engine, the impeller is creating only a small pressure and flowrate for circulating the coolant through the engine. While still cold, if the engine is working at higher revs, the pressure and flowrate are higher, which opens the flap-valve. The flap-valve 205, and the flap-spring 207, can be designed to be closed when the engine is working at low speeds, including idling, and to open when the engine is working at higher speeds.

The operation of the flap-valve facility is as follows. When starting from cold, the ports 197,198 are aligned, as shown in FIG. 16A, whereby bypass flow is enabled. However, the flap-valve 205 only allows bypass flow to take place, through the aligned ports, if the engine revs are high, as they are in FIG. 16A. If the engine revs are low, the flap 206 closes, blocking the bypass-port 202, whereby coolant cannot now circulate through the engine is blocked and cannot circulate through the engine. Thus, the coolant does not circulate during cold idling—which means that the coolant in the engine warms up very rapidly. Once the coolant starts to warm up, the thermal sensor detects this, and the thermal actuator opens the vanes to permit flow through the radiator, and closes the bypass port. Equally, if the engine is revved much above idling speed when the coolant is very cold (and the ports 197,198 are therefore aligned), the increased impeller pressure forces the flap 206 to open the bypass-port 202. Thus, the flap 206 can only block the bypass-flow if the engine is idling.

Again, if the coolant is not circulating, even if the coolant is very cold, the danger is that hotspots might develop and might damage the engine. But that danger is practically non-existent if the engine is idling, and the flap-valve functions to allow the bypass flow to commence if the engine were to be revved.

However, the prudent designer might wish to take further precautions, to guard against the possible dangers arising from blocking the bypass-flow. When the thermal-sensor comprises an electrical or electronic temperature sensor (or several sensors) it is a simple matter for the sensor(s) to be located in a hot-spot-prone location of the engine. Engine computers are routinely employed to receive the readings from various sensors, engine speed indicator, etc, to arrive at the decision whether to block the bypass flow. As show in FIG. 18, the flap 206 can then be actuated by a suitable electrical servo or solenoid 210, as well as (or instead of) by the flap-spring 207.

It will be understood that the other embodiments and designs as described herein can likewise be so modified as to be able to adopt a very-cold position in which the coolant bypass port is closed. Again, the designer arranges for the bypass port to be open when the coolant is cold—but to be closed when the coolant is very cold, and to be closed also when the coolant is warm or hot.

Figure 19A:
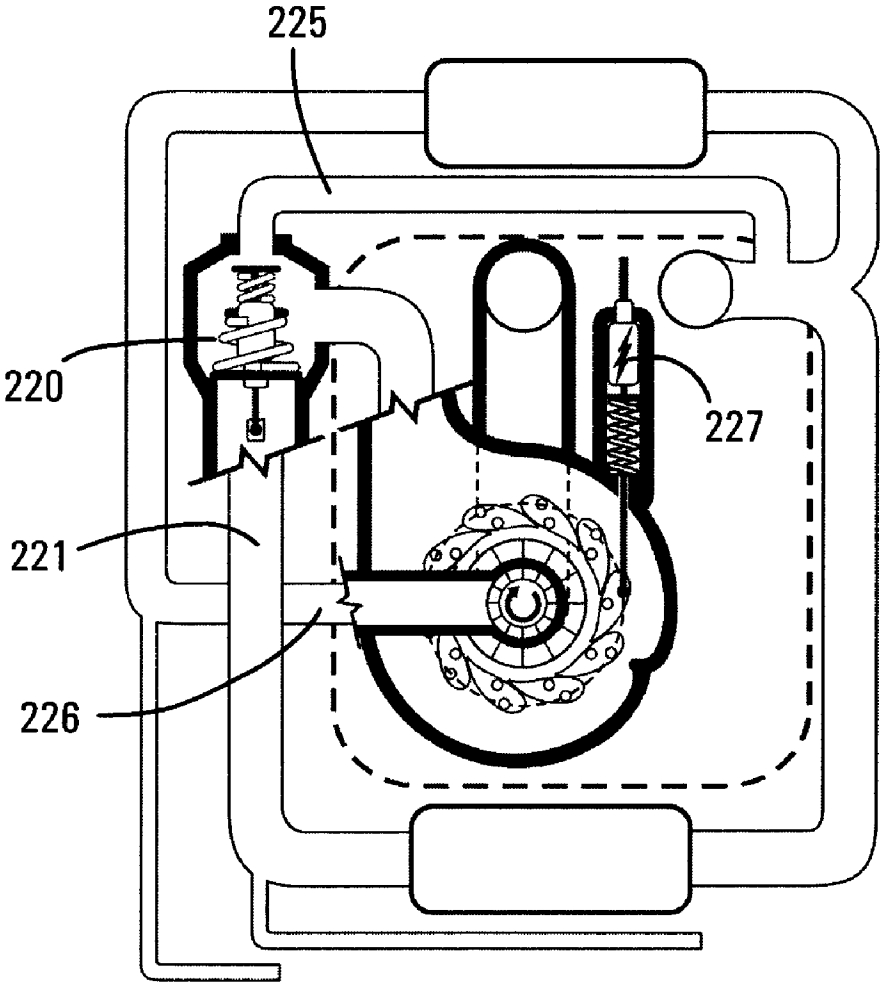
FIGS. 19*a*,19*b* show a system which includes the provision of a conventional thermostat.
Figure 19B:
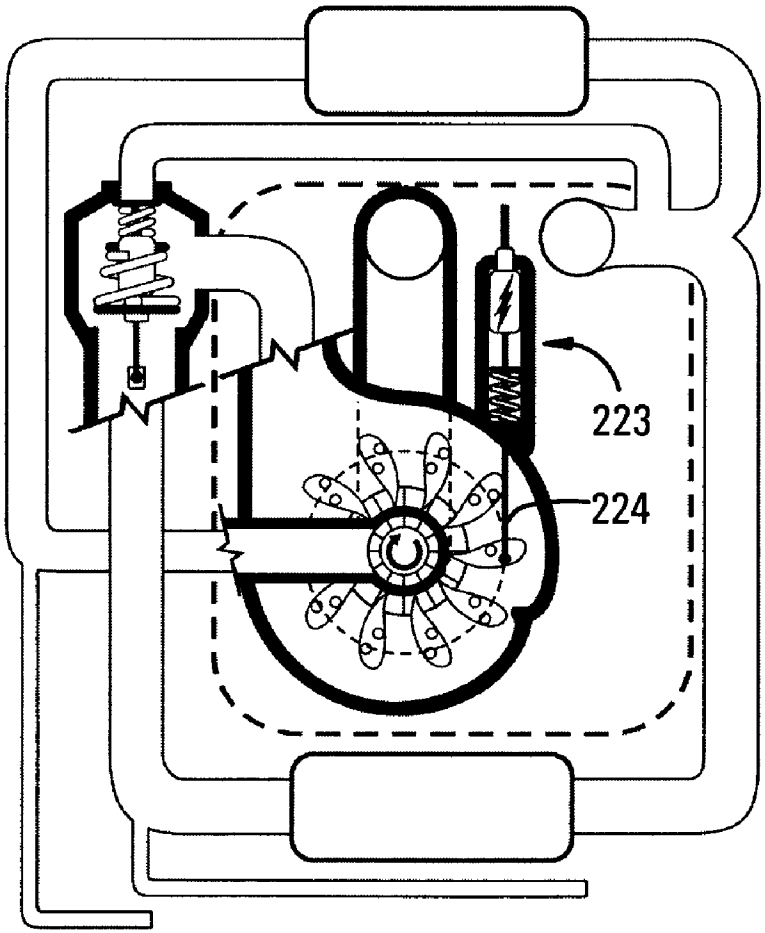

In some cases, the designer might wish to retain the traditional engine thermostat. FIGS. 19A,19B show such an arrangement. In FIG. 19A, the coolant is cold, and the thermostat 220 is now blocking the in-from-radiator port 221. A thermal sensor/actuator 223 controls and operates the opening of the set of vanes 23. When the coolant is very cold, upon initial starting of the engine, the stem 224 holds the vanes oriented to the fully-closed position. Thus, bypass flow from the bypass port 225 is blocked by the closed vanes, as well as radiator flow from the in-from-radiator port 221.

(In the FIGS. 19A,19B apparatus, the in-from-heater port 226 remains open all the time, allowing a heater-flow to pass through the impeller and into the engine. Therefore, flow through the FIGS. 19A,19B engine is never altogether zero.)

As the coolant warms up slightly, that fact is sensed by the thermal sensor(s), and the stem 224 extends (downwards in FIG. 19A) and starts to open the vanes. Now, the bypass flow can begin to move through the bypass-port 225. The bypass flow continues as the coolant temperature increases to the warm condition. Once the coolant is warm, now the thermostat 220 operates, and moves towards the position shown in FIG. 19B, thereby opening the in-from-radiator port 221. At the same time, the thermostat 220 blocks the bypass-port 225. (It is not required that the two things be done simultaneously;

the designer should assess the sequence and timing for best results.) Then, as the coolant lies between the warm and hot conditions, the orientation of the vanes is controlled by the thermal sensor/actuator, modulating the orientation of the vanes between flow-reduce and flow-boost as previously described.

In fact, in FIGS. 19A,19B, the set of vanes 23 is operated by an electrical servo 227. Temperature sensors, which dictate the movement of the stem 224, are located in suitable places in the engine. The computer that controls the operation of the servo is programmed to minimise the warm-up time, and to minimise the exposure of the engine to the danger of local overheating, as described.

The apparatuses as described herein are shown with conventional wax-bulb thermostat units, whereby the thermal-sensor and the thermal-actuator are mechanically combined. As mentioned, the thermal-sensor can comprise one or more temperature sensors that output to a data bus, and the thermal-actuator in that case can comprise a servo unit (which may be a simple solenoid or stepper motor) to create the required mechanical movement. Generally, the different types of thermal-sensor and thermal-actuator should be regarded as interchangeable.

Figure 20B:
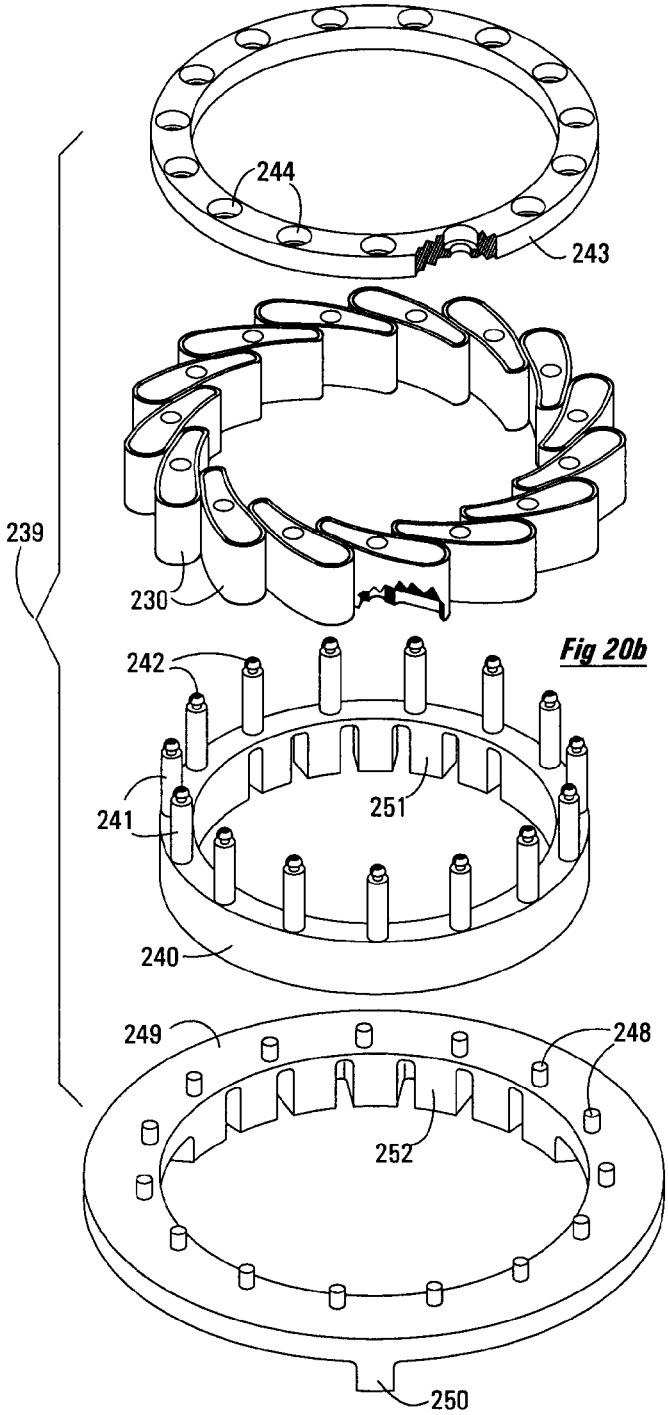
FIG. 20*b* is an exploded view of an apparatus that uses the vane of FIG. 20*a*.
Figure 20C:
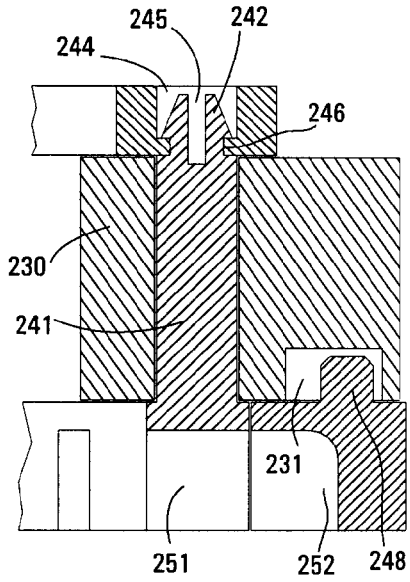
FIG. 20*c* is a section of a portion of the apparatus of FIG. 20*b*.
Figure 20A:
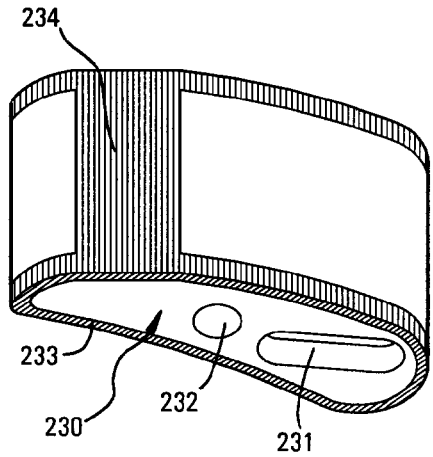
FIG. 20*a* shows another design of vane

FIG. 20*a* shows a variant on the design of the vane. In this variant, the vane 230 is formed with a socket 231, which is shaped to receive a drive-peg that is fixed into the vanes-drive-ring. This may be contrasted with the apparatuses of the other drawings, in which the drive-peg is in the vane and the slot is in the vanes-drive-ring. Also, in the vane 230, the vane-spindle is separate from the vane itself, being inserted into the through-hole 232 in the vane. Also, in the vane 230, elastomeric seal material is directly moulded-into the (plastic) material of the vane. Thus, all of the seal material, as illustrated by the hatched areas 233,234, is unitary with the vane itself.

The apparatus 239 depicted in FIG. 20*b* is similar to that shown in FIGS. 16*a*,16*b*, but makes use of the design of vane 230 as shown in FIG. 20*a*. In FIG. 20*b*, a bottom-stator-ring 240 has fixed into it a set of vane-spindles 241, on which the vanes 230 are pivotable. The vane-spindles 241 are formed at their top ends with respective headed stalks 242, as shown in FIG. 20*c*. A top-stator-ring 243 is provided with respective shaped sockets 244, which receive the headed stalks 242.

The bottom-stator-ring 240, the top-stator-ring 243, and the vanes 230, form a stack, which is a sub-assembly that is locked together by the engagement of the headed stalks 242 with the shaped sockets 244. Each headed stalk 242 is split, at 245, so that the head of the stalk 242 can deflect inwards, to enable the head to pass through the hole 246 in the socket 244. When the headed stalks have snapped through into their respective sockets, the sub-assembly becomes a unitary stack.

In the stack, the vanes 230 can pivot about the respective vane-spindles 241 for the purposes of adopting the thermally-dictated orientations as described. The vane-spindles provide a solid base about which vanes can move, by the fact that each vane-spindle is held securely at both ends by its tight engagement with the top- and bottom-stator-rings. The vanes 230 also are sealed between the two stator-rings 240,243 by the contact between the elastomeric seal material 233 and the stator-rings. The vanes 230 seal to each other (when they are in the closed orientation) by the engagement of the vanes with the respective sealing areas 234 on adjacent vanes.

The orientations of the vanes 230 are controlled by the engagement of pegs with the slots 231. The drive-pegs 248 on the vanes-drive-ring 249 perform this function. The vanes-drive-ring 249 fits outside the bottom-stator-ring 240, and is rotatable relative to it. The vanes-drive-ring 249 is caused to rotate by the engagement of the tab 250 thereon with a complementary pickup in a stem (not shown in FIG. 20*b*, but it is similar to that shown at 190 in FIG. 16*b*) which is actuated by a suitable thermal-actuator.

The vanes-drive-ring 249 and the bottom-stator-ring 240 have respective slotted skirts 251,252, which interact with each other in the same manner as in FIGS. 16*a*,16*b*, to open the bypass-port when the slots are aligned and to block the bypass-port when not aligned.

Some of the components of the apparatuses depicted herein, although shown only in one of or some of the apparatuses, are intended to be interchangeable between the different apparatuses, unless otherwise indicated. The skilled designers of coolant systems will understand that it is not practicable to draw all the variants in which the components might be interchanged, but will understand that that can be done.

Skilled designers of automatic coolant systems will understand that the nomenclatures "top", "bottom", etc, as used herein are not intended to be limiting as to orientation of the physical structures, in use. Rather, the nomenclatures should be construed as applying to a design of an apparatus as represented on paper that is oriented appropriately, in which those terms can be applied coherently.

The invention claimed is:

1. Apparatus for conveying coolant around a cooling circuit of an automotive engine, characterised by the combination of the following features:

the cooling circuit includes a pump impeller, which is driven in rotation, for circulating coolant, and includes a radiator;

the cooling circuit includes a bypass-circuit for conveying a bypass-flow of coolant, being a flow that bypasses the radiator, and which passes through a bypass-port;

the apparatus includes a bypass-port-blocker, which is movable between:-

(a) an open position in which the bypass-port is open and the bypass flow circulates around the engine, and (b) a closed position in which the bypass-port-blocker blocks the bypass-port, thereby blocking circulation of coolant around the bypass circuit;

the apparatus includes a thermal-sensor, in operative association with a movable thermal-actuator;

the operative association is such that, when the thermal-sensor detects changes in temperature of the coolant, the thermal-actuator undergoes physical movement proportionally responsively to the said temperature changes;

the thermal-actuator is capable of moving between the following positions, corresponding to temperatures detected by the thermal-sensor, namely: a cold position, a warm position, and a hot position;

the apparatus includes a set of flow-modulating vanes, which is capable of modulating the radiator-flow, the vanes being arranged in a housing for movement between a flow-reducing orientation of the vanes and a flow-boosting orientation;

the thermal-actuator, in moving from the warm position to the hot position, moves the vanes from their flow-reducing orientation to their flow-boosting orientation;

in the cold position of the thermal-actuator, the bypass-port-blocker lies in an open position, enabling flow through the bypass port; and the thermal-actuator, in moving from the cold position to the hot position, moves the bypass-port-blocker to close the bypass port.

2. As in claim 1, further characterised in that:

the thermal-actuator includes a movable arm, which undergoes a mechanical movement in a first direction in response to an increase in the temperature detected by the thermal-sensor, and undergoes a reverse movement, in the opposite direction, in response to a decrease in the temperature detected by the thermal-sensor;

in moving from the cold position to the hot position of the thermal actuator, the arm moves to pick up and move the bypass-port-blocker to close the bypass port;

in moving from the warm position to the hot position of the thermal actuator, the arm moves to pick up and move the set of vanes from the flow-reducing orientation to the flow-boosting orientation.

3. As in claim 1, further characterised in that:

the thermal-actuator is capable of moving also to a very-cold position;

in the very-cold position of the thermal-actuator, the bypass-port-blocker lies in a closed position;

the thermal-actuator, in moving from the very-cold position to the cold position, moves the bypass-port-blocker to open the bypass port.

4. As in claim 1, further characterised in that:

the cooling circuit includes a radiator-circuit for conveying a radiator-flow of coolant, being a flow that passes through the radiator, and through a radiator-port;

the apparatus includes a rad-port-blocker, which is movable between:-

(a) a closed position in which the rad-port-blocker blocks the radiator-port, thereby blocking coolant from passing through the impeller and entering the radiator-circuit, and (b) an open position in which the rad-port is open and coolant circulates through the radiator;

in the cold position of the thermal-actuator, the rad-port-blocker lies in the closed position, blocking flow through the radiator-port; and the thermal-actuator, in moving from the cold position to the hot position, moves the rad-port-blocker to open the radiator-port.

5. As in claim 1, further characterised in that:

the thermal-actuator undergoes travel, unidirectionally, from a very cold position, through the cold position, the warm position, and the hot position, to a very hot position, corresponding to the temperature as sensed by the thermal-sensor going from very cold to very hot;

the apparatus includes a mechanical arm that is arranged to follow movement of the thermal-actuator, and to follow said movement in the following manner: - the arm moves from position-VC to position-C when the thermal-sensor senses a change in temperature from very cold to cold;

the arm moves from position-C to position-W when the thermal-sensor senses a change in temperature from cold to warm;

the arm moves from position-W to position-H when the thermal-sensor senses a change in temperature from warm to hot;

the arm moves from position-H to position-VH when the thermal-sensor senses a change in temperature from hot to very hot;

the arm so connects to the vanes that the arm, in going from position-W to position-H moves the vanes and changes the orientations of the vanes from the flow-reducing orientation to the flow-boosting orientation;

the arm so connects to the bypass-port-blocker that the arm, in moving from position-C to position-W, moves the bypass-port-blocker to block the bypass-port.

6. As in claim 5, further characterised in that:

the arm so connects to the vanes that, in moving from position-VC to position-C, the arm moves the vanes from a closed orientation in which the vanes are sealed closed to the passage of coolant therethrough, to an open orientation in which the vanes are open enough to allow coolant to flow between the vanes to the impeller;

the bypass-port includes the vanes, whereby the bypass-port is blocked when the vanes are in the closed orientation.

7. As in claim 5, further characterised in that:

the arm so connects to the rad-port-blocker that the arm, in moving from position-C to position-W, moves the rad-port-blocker from blocking the radiator-port to opening the radiator-port;

the arm so connects to the vanes that, in moving from position-C to position-W, the arm moves the vanes from a closed orientation in which the vanes are sealed closed to the passage of coolant therethrough, to an open orientation in which the vanes are open enough to allow coolant to flow between the vanes to the impeller;

the radiator-port includes the vanes, whereby the radiator-port is blocked when the vanes are in the closed orientation.

8. As in claim 1, further characterised in that the apparatus includes a rad-port-blocker, which is movable between (a) a closed position in which the rad-port-blocker blocks the radiator-port, thereby blocking coolant from passing through the impeller entering the around the radiator-circuit, and (b) an open position in which the rad-port is open and coolant circulates through the radiator;

in the cold position of the thermal-actuator, the rad-port-blocker lies in the closed position, blocking flow through the radiator-port; and the rad-port-blocker is independently operable, in that operative movement of the rad-port-blocker is independent of the said thermal-actuator that operates the vanes.

9. As in claim 1, further characterised in that:

the vanes impart a circumferential component of velocity to the flow of coolant in the radiator-circuit;

the vanes are located upstream of the impeller, and are close enough to the impeller that the flow still has that circumferential component when entering the impeller;

the vanes, in undergoing a change in orientation, pivot on spindles that are parallel to each other and to the axis of the spindle;

the apparatus includes a vanes-drive-ring, which engages all the vanes, the apparatus being so arranged that rotation of the vanes-drive-ring causes all the vanes to change orientation in unison;

the arm connects to the vanes-drive-ring in such manner that when the arm moves from its position-W to its position-H, the arm rotates the vanes-drive-ring to change the orientation of the vanes from flow-reducing to flow-boosting.

10. As in claim 9, further characterised in that:

the vanes form a circumferentially-incomplete encirclement around the impeller, leaving a gap;

the bypass-port includes the said gap;

the vanes form a circumferentially-complete encirclement around the impeller, leaving no gap;

the bypass-port includes an opening that delivers coolant in an axial direction into the impeller.

11. Apparatus for conveying coolant around a cooling circuit of an automotive engine, characterised by combining the following features:

the cooling circuit includes a pump impeller, which is driven in rotation, for circulating the coolant;

the apparatus includes a set of flow-modulating vanes, the set being capable of modulating a flow of coolant, and the set being arranged in a housing for movement between a flow-reducing orientation of the vanes and a flow-boosting orientation;

the set of vanes is capable also of being orientated to a fully-closed orientation of the vanes;

the apparatus includes a vanes-sealing-means, of such structure as to be effective to seal the set of vanes against coolant passing therethrough in the fully-closed orientation thereof;

the vanes-sealing-means includes:- respective top-sealing-surfaces and bottom-sealing-surfaces on the vanes; and a top-sealing-plate and a bottom-sealing-plate;

the top-sealing-plate, the vanes, and the bottom-sealing-plate, lie in a stack, in which:- the top-sealing-surfaces of the vanes lie in sealing contact with the top-sealing-plate and the bottom-sealing-surfaces of the vanes lie in sealing contact with the bottom-sealing-plate;

the top-sealing-plate and the bottom-sealing-plate are movable relative to the vanes, in the direction towards and away from the vanes;

the vanes-sealing-means includes a resilience, which is effective to provide a resilient compression urging the top-sealing-surfaces of the vanes into sealing contact with the top-sealing-plate and the bottom-sealing-surfaces of the vanes into sealing contact with the bottom-sealing-plate.

12. As in claim 11, further characterised in that:

the top-sealing-plate and the bottom-sealing-plate are movable relative to the vanes, in that:- the bottom-sealing-plate and the top-sealing-plate are fixed with respect to each other;

the resilience is included as respective components of the vanes, whereby the set of vanes is of a variable height in the stack;

the resilience is structured to such effect that the resilience exerts resilient force urging the top-sealing-surfaces of the vanes into contact with the top-sealing-plate and exerts resilient force urging the bottom-sealing-surfaces of the vanes into sealing contact with the bottom-sealing-plate.

13. As in claim 11, further characterised in that:

the vanes, in undergoing a change in orientation, pivot on spindles that are parallel to each other and to the rotary axis of the impeller;

the vanes are movable relative to the top-sealing-plate and the bottom-sealing-plate also in the circumferential sense, in that the vanes can move relative to the top-sealing-plate and the bottom-sealing-plate when undergoing a change of orientation.

14. As in claim 11, further characterised in that:

some components of the apparatus comprise a pre-assembly module, including the vanes, the vane-spindles, the resilient-means, a bottom-mounting-plate, and a retainer;

the pre-assembly module is characterised in that:- the vane-spindles lie with their axes parallel to each other;

the vane-spindles are mounted in the mounting-plate in such manner that the mounting plate constrains the vane-spindles against lateral movement of the vane-spindles, yet the vanes can pivot about the vane-spindles relative to the mounting-plate;

the retainer is so structured as to retain the vanes from separating from the mounting-plate.

15. As in claim 14, further characterised in that:- the pre-assembly module also includes the resilience, and includes the bottom sealing plate;

the bottom-sealing-plate is separate from, and is guided, in the module, for movement axially relative to the bottom-mounting-plate;

the bottom-sealing-plate has a sealing-surface in contact with the bottom sealing surface of the vanes;

characterised in that:

the resilience is capable of resilient deflection to a dimension D, being a dimension of the resilience as measured in the direction of the axes of the vane-spindles;

the maximum and minimum dimensions of the distance D, between which the resilience exerts resilient force, being D1 and D2;

the said resilient force acts parallel to the direction of the axes of the vane spindles;

the bottom-sealing-plate lies in direct touching contact with the bottom-sealing-surfaces of the vanes;

the arrangement of the module is such that the resilient force acts to urge the bottom-sealing-surfaces and the bottom sealing-plate together;

the retainer is structured to retain the vanes from separating from the mounting-plate beyond a separation-distance, which leaves the magnitude of the dimension D between D1 and D2.

16. As in claim 15 further characterised in that:

the pre-assembly module also includes the top-sealing-plate;

the arrangement of the module is such that the resilience also resiliently loads the top-sealing-surfaces of the vanes in direct touching contact with the top-sealing-plate;

the retainer holds the top-sealing-plate in a fixed relationship with the bottom mounting-plate, ad the reaction to the said resilient force is transmitted through the retainer.

17. As in claim 11, further characterised in that the said resilience is provided in the form of one of either a metal spring or an elastomeric material that is itself capable of resilient deflection.

18. As in claim 11, further characterised in that:

the vanes-sealing-means includes, in respect of each vane, respective vane-side-sealing means, which are structured to be effective, when the vanes are closed together, to provide a substantially watertight seal between adjacent vanes;

the engineered seal between the respective top-sealing-surfaces and the top-sealing-plate is termed the top seal;

the engineered seal between the respective bottom-sealing-surfaces and the bottom-sealing-plate is termed the bottom seal;

the engineered seal between adjacent vanes is termed the side seal.

19. Apparatus for conveying coolant around a cooling circuit of an automotive engine, characterised by the combination of the following features:

the cooling circuit includes a pump impeller, which is driven in rotation, for circulating coolant, and includes a radiator;

the apparatus includes a thermal-sensor, in operative association with a movable thermal-actuator;

the operative association is such that, when the thermal-sensor detects changes in temperature of the coolant, the thermal-actuator undergoes physical movement proportionally responsively to the said temperature changes;

the thermal-actuator is capable of moving between the following positions, corresponding to temperatures detected by the thermal-sensor, namely: a cold position, a warm position, and a hot position;

the apparatus includes a set of flow-modulating vanes, which is capable of modulating the radiator-flow, the vanes being arranged in a housing for movement between a flow-reducing orientation of the vanes and a flow-boosting orientation;

the thermal-actuator, in moving from the warm position to the hot position, moves the vanes from their flow-reducing orientation to their flow-boosting orientation;

in the cold position of the thermal-actuator, the bypass-port-blocker lies in an open position, enabling flow through the bypass port; and the thermal-actuator, in moving from the cold position to the hot position, moves the bypass-port-blocker to close the bypass port;

some components of the apparatus comprise a pre-assembly module, including the vanes, the vane-spindles, the resilient-means, a bottom-mounting-plate, and a retainer;

the pre-assembly module is characterised in that:- the vane-spindles lie with their axes parallel to each other;

the vane-spindles are mounted in the mounting-plate in such manner that the mounting plate constrains the vane-spindles against lateral movement of the vane-spindles, yet the vanes can pivot about the vane-spindles relative to the mounting-plate;

the retainer is so structured as to retain the vanes from separating from the mounting-plate.

20. Apparatus for conveying coolant around a cooling circuit of an automotive engine, characterised by the combination of the following features:

the cooling circuit includes a pump impeller, which is driven in rotation, for circulating coolant, and includes a radiator;

the apparatus includes a thermal-sensor, in operative association with a movable thermal-actuator;

the operative association is such that, when the thermal-sensor detects changes in temperature of the coolant, the thermal-actuator undergoes physical movement proportionally responsively to the said temperature changes;

the thermal-actuator is capable of moving between the following positions, corresponding to temperatures detected by the thermal-sensor, namely: a cold position, a warm position, and a hot position;

the apparatus includes a set of flow-modulating vanes, which is capable of modulating the radiator-flow, the vanes being arranged in a housing for movement between a flow-reducing orientation of the vanes and a flow-boosting orientation;

the thermal-actuator, in moving from the warm position to the hot position, moves the vanes from their flow-reducing orientation to their flow-boosting orientation;

the cooling circuit includes a radiator-circuit for conveying a radiator-flow of coolant, being a flow that passes through the radiator, and through a radiator-port;

the radiator-port is of such configuration that coolant entering the vanes divides into two flows, one entering vanes on the left side and the other flow entering vanes on the right;

the vanes are shaped with a substantially symmetrical semi-circular entry profile;

the vanes are pitched such that, at least approximately, the spaces between the vanes are equal to the thicknesses of the vanes, when measured on the circle that includes the thickest part of the vanes;

the vanes are profiled such that, at least at the flow-boosting orientation, the spaces between the vanes progressively and gradually narrows as the radius becomes smaller.

* * * * *